US008126387B2

(12) United States Patent
Noguchi et al.

(10) Patent No.: US 8,126,387 B2
(45) Date of Patent: Feb. 28, 2012

(54) SHEET CONVEYING DEVICE AND IMAGE FORMING APPARATUS

(75) Inventors: Hidetaka Noguchi, Kanagawa (JP); Toshiyuki Andoh, Kanagawa (JP); Takashi Hodoshima, Kanagawa (JP); Tatsuhiko Oikawa, Kanagawa (JP); Seiji Hoshino, Kanagawa (JP); Hiromichi Matsuda, Kanagawa (JP); Makoto Komatsu, Kanagawa (JP); Takashi Hashimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 945 days.

(21) Appl. No.: 12/128,337

(22) Filed: May 28, 2008

(65) Prior Publication Data

US 2008/0303202 A1 Dec. 11, 2008

(30) Foreign Application Priority Data

Jun. 8, 2007 (JP) ..... 2007-153189
Dec. 3, 2007 (JP) ..... 2007-312276

(51) Int. Cl.
*G03G 15/00* (2006.01)
*G03G 15/01* (2006.01)

(52) U.S. Cl. ..... 399/396; 399/167; 399/388

(58) Field of Classification Search ..... 399/167, 399/396

See application file for complete search history.

(56) References Cited

U.S. PATENT DOCUMENTS

| | | | | |
|---|---|---|---|---|
| 5,519,478 | A | 5/1996 | Malachowski | |
| 6,501,931 | B2 * | 12/2002 | Matsumoto | 399/167 |
| 7,343,119 | B2 * | 3/2008 | Matsuda et al. | 399/167 |
| 7,907,872 | B2 * | 3/2011 | Komatsu et al. | 399/167 |

FOREIGN PATENT DOCUMENTS

| | | | |
|---|---|---|---|
| JP | 2000-330353 | | 11/2000 |
| JP | 2003-215870 | | 7/2003 |
| JP | 2004-54120 | | 2/2004 |
| JP | 2004054120 | A * | 2/2004 |
| JP | 2005-107118 | | 4/2005 |
| JP | 2005107118 | A * | 4/2005 |
| JP | 2005221622 | A * | 8/2005 |
| JP | 2006-85153 | | 3/2006 |
| JP | 2006-154739 | | 6/2006 |
| JP | 2007-52111 | | 3/2007 |
| JP | 2008-94573 | | 4/2008 |
| WO | WO 2006122557 | A1 * | 11/2006 |

OTHER PUBLICATIONS

Machine Translation of JP 2005107118 A, JPO, Jul. 15, 2011.*
Machine Translation of JP 2004054120 A, JPO, Jul. 15, 2011.*

* cited by examiner

*Primary Examiner* — Judy Nguyen
*Assistant Examiner* — Nguyen Q Ha
(74) *Attorney, Agent, or Firm* — Oblon, Spivak, McClelland, Maier & Neustadt, L.L.P.

(57) ABSTRACT

A fluctuation detecting unit detects a fluctuation of an endless belt generated when a sheet is brought into contact with a predetermined position of the endless belt at an upstream side in a conveying direction from a nip portion based on fluctuation information acquired by a fluctuation information acquiring unit. An entry timing estimating unit estimates entry timing of the sheet into the nip portion based on a detection of the fluctuation. A correction control unit corrects a speed fluctuation of the endless belt generated when the sheet enters the nip portion by performing a feedforward control of a first driving unit based on the entry timing.

15 Claims, 18 Drawing Sheets

SHEET CONVEYING DEVICE AND IMAGE FORMING APPARATUS

CROSS-REFERENCE TO RELATED APPLICATIONS

The present application claims priority to and incorporates by reference the entire contents of Japanese priority documents, 2007-153189 filed in Japan on Jun. 8, 2007 and 2007-312276 filed in Japan on Dec. 3, 2007.

BACKGROUND OF THE INVENTION

1. Field of the Invention

The present invention relates to a sheet conveying device and an image forming apparatus that includes the sheet conveying device.

2. Description of the Related Art

In recent years, in color image forming apparatuses, an intermediate transfer method that primarily transfers a toner image on a photosensitive body on an intermediate transfer body, and then secondarily transfers the toner image in four colors on the intermediate transfer body on a sheet has been widely used. The image forming apparatus using the intermediate transfer body has an advantage of high versatility that various types of sheets such as a thin paper, a thick paper, a postcard, and an envelope can be used. An intermediate transfer drum or an intermediate transfer belt is generally used for the intermediate transfer body.

However, when a sheet above a certain thickness enters a secondary transferring unit, the speed of the intermediate transfer body driven at a constant speed up to then fluctuates for a short time, thereby causing a problem of generating a distortion in an image at a primary transferring unit.

With miniaturization of color image forming apparatuses, the secondary transferring unit and a fixing unit have been arranged close to each other, and in some apparatuses, the transferring and the fixing of an image are carried out on the sheet at the same time. In such an apparatus, when the sheet above a certain thickness enters the fixing unit, the speed of a fixing roller or a fixing belt that were driven at a constant speed up to then also fluctuates for a short time, thereby causing the same problem of generating a distortion in an image at the secondary transferring unit.

These problems can be prevented by feedforward control that, before the sheet enters the secondary transferring unit or the fixing unit, estimates the entry timing, and negates a speed fluctuation by increasing the speed and a torque of the intermediate transfer body and the like that fluctuate at the entry of the sheet. In related art, the following proposals have been made.

Japanese Patent Laid-open Publication No. 2003-215870 discloses an image forming apparatus that measures the time from the start of printing to the entry of a sheet into a transferring unit, and uses the measured time originating the start of printing as the timing for the next feedforward control.

Japanese Patent Laid-open Publication No. 2005-107118 discloses an image forming apparatus that measures the time from the start of clutching of a resist roller to the entry of a sheet into a secondary transferring unit in advance, and uses the measured time originating the start of clutching of the resist roller as the timing for the next feedforward control.

Japanese Patent Laid-open Publication No. 2004-54120 discloses an image forming apparatus installed with a paper detection sensor immediately before a fixing unit, and carries out the feedforward control by the detection signal.

In this manner, in the related-art image forming apparatus, the entry timing (timing of the entry of a sheet into the transferring unit and the fixing unit) to carry out the feedforward control is triggered by various forms such as the start of printing, the start of clutching of the resist roller, or the detection by the paper detection sensor. However, the following problems occur:

In the image forming apparatus disclosed in the Japanese Patent Laid-open Publication No. 2003-215870, a fluctuation occurs to the time from the start of printing to the entry of the sheet into the transferring unit, thereby causing an error to the measured time obtained in advance. Accordingly, it is difficult to obtain the accurate timing for the feedforward control.

In the image forming apparatus disclosed in the Japanese Patent Laid-open Publication No. 2005-107118, similarly to the above, a large fluctuation occurs to the time from the start of clutching of the resist roller to the entry of the sheet into the secondary transferring unit, thereby causing an error to the measured time obtained in advance. Accordingly, it is difficult to obtain the accurate timing for the feedforward control. Even with the steady clutching time, in practice, the entry timing of the sheet fluctuates every time, thereby making it difficult to carry out the accurate feedforward control using the value measured in advance, and causing a problem in the accuracy. Because the entry timing of the sheet changes due to deterioration of parts and deterioration with age, it is difficult to secure stability over time.

In the image forming apparatus disclosed in the Japanese Patent Laid-open Publication No. 2004-54120, the paper detection sensor is installed immediately before the fixing unit, and the feedforward control is carried out by the detection signal. However, the timing from the detection of the sheet by the sensor to the entry of the sheet into the fixing unit fluctuates due to the error in the sensor detection position, thereby making it difficult to obtain the accurate timing for the feedforward control. Moreover, there was a limitation in reducing the distance between the detection sensor and the fixing unit to reduce the detection error, due to the structural restriction.

SUMMARY OF THE INVENTION

It is an object of the present invention to at least partially solve the problems in the conventional technology.

According to an aspect of the present invention, there is provided a sheet conveying device including a first roller over which an endless belt is supported, a second roller arranged opposite to the first roller, and a first driving unit that drives the endless belt, and conveys a sheet to a nip portion formed by pressing the first roller and the second roller against each other with the endless belt therebetween. The sheet conveying device further includes a fluctuation information acquiring unit that acquires fluctuation information of the endless belt; a fluctuation detecting unit that detects a fluctuation of the endless belt generated when the sheet is brought into contact with a predetermined position of the endless belt at an upstream side in a conveying direction from the nip portion, based on the fluctuation information acquired by the fluctuation information acquiring unit; an entry timing estimating unit that estimates entry timing of the sheet into the nip portion based on a detection of the fluctuation by the fluctuation detecting unit; and a correction control unit that corrects a speed fluctuation of the endless belt generated when the sheet enters the nip portion by performing a feedforward control of the first driving unit based on the entry timing estimated by the entry timing estimating unit.

Furthermore, according to another aspect of the present invention, there is provided an image forming apparatus including a sheet conveying device applied to at least one of an intermediate transfer unit and a fixing unit. The sheet conveying device conveys a sheet to a nip portion formed by pressing a first roller over which an endless belt is supported and a second roller arranged opposite to the first roller against each other with the endless belt therebetween. The sheet conveying device includes a first driving unit that drives the endless belt, a fluctuation information acquiring unit that acquires fluctuation information of the endless belt, a fluctuation detecting unit that detects a fluctuation of the endless belt generated when the sheet is brought into contact with a predetermined position of the endless belt at an upstream side in a conveying direction from the nip portion, based on the fluctuation information acquired by the fluctuation information acquiring unit, an entry timing estimating unit that estimates entry timing of the sheet into the nip portion based on a detection of the fluctuation by the fluctuation detecting unit, and a correction control unit that corrects a speed fluctuation of the endless belt generated when the sheet enters the nip portion by performing a feedforward control of the first driving unit based on the entry timing estimated by the entry timing estimating unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
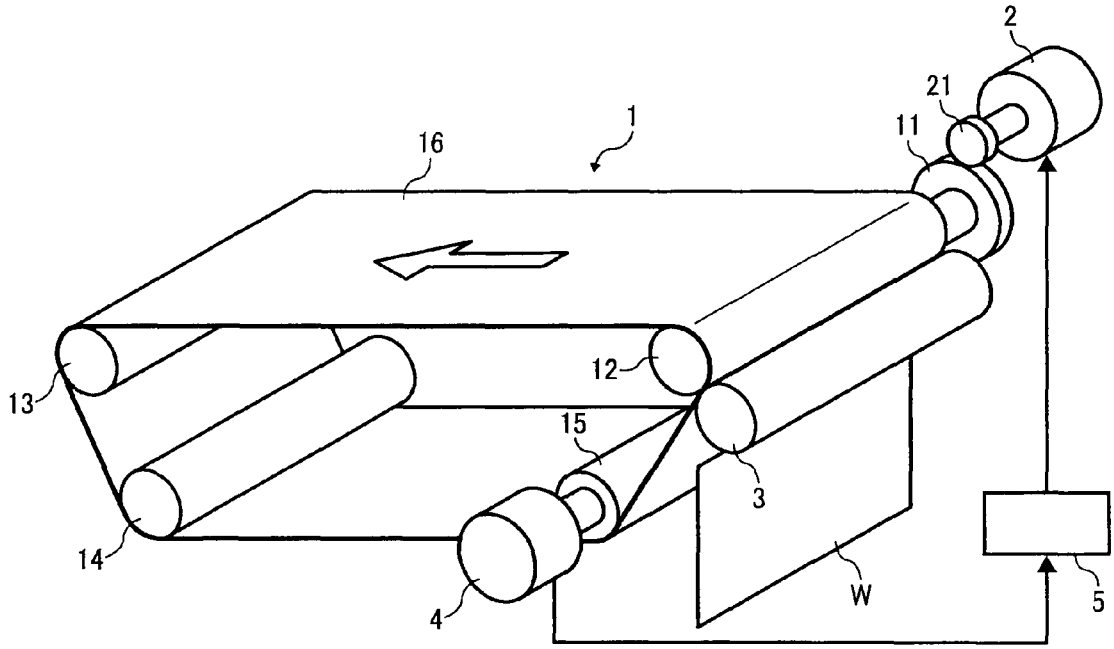
FIG. 1 is a schematic perspective view of a sheet conveying device according to a first embodiment of the present invention.

Exemplary embodiments of the present invention will be explained in detail below with reference to the accompanying drawings. A sheet conveying device according to a first embodiment includes a holding and conveying unit, and a correction control unit. The holding and conveying unit, as shown in FIG. 1, includes a belt unit 1, a first driving unit 2, and a pressure roller 3 (second roller). The belt unit 1 is formed in an inverted isosceles trapezoid that includes a driving roller 12 (first roller) of which a large diameter gear 11 is fixed to an end and rotatably supported to a machine frame, which is not shown, an upper support roller 13 rotatably supported to the machine frame in the required interval from the driving roller 12 in a horizontal direction, and a pair of lower support rollers 14 and 15 horizontally and rotatably supported to the machine frame below the rollers (driving roller 12 and upper support roller 13), with the required pitch shorter than the pitch arranged between the upper support roller 13 and the driving roller 12. An endless belt 16 is set over the four rollers. Among these, the upper support roller 13 is supported so as to bias towards outside by an elastic member such as a spring (not shown), to maintain the constant tension of the endless belt 16.

In the present embodiment, a configuration of arranging four rollers in an inverted isosceles trapezoid is explained. However, the configuration may be made by arranging three support rollers in a triangular shape excluding the lower support roller 14 arranged below the side of the upper support roller 13. Or, the configuration may be made by excluding the lower support rollers 14 and 15. As long as there are two or more, the number of the support rollers is not particularly limited. The arrangement of each support roller is not limited to the inverted isosceles trapezoid or the triangular shape, but any arrangement may be employed.

The first driving unit 2 is a motor supported to the machine frame and electrically connected to a drive control unit 5, which will be explained later. The rotation output from the first driving unit 2 is transmitted to the driving roller 12 via a speed reduction mechanism that includes a small diameter gear 21 fixed to a rotation axis of the motor and the large diameter gear 11 meshed with the small diameter gear 21 and fixed to an end of the driving roller 12.

The first driving unit 2 may be, for example, any one of a brushless DC motor, a pulse motor, a brush DC motor, an ultrasonic motor, and a direct drive motor. When the ultrasonic motor or the direct drive motor is used, with the characteristics of the motor, it is possible to drive the driving roller 12 directly, without using the speed reduction mechanism formed by the small diameter gear 21 and the large diameter gear 11. The other speed reduction mechanisms are, for example, a speed reduction mechanism that includes a belt such as a timing belt and a V-belt, and a pulley, a speed reduction mechanism that uses a planetary gear (planetary gear mechanism), a speed reduction mechanism that uses a worm gear, and a multi-stage speed reduction mechanism having a gear train. However, the speed reduction mechanism is not particularly limited as long as the speed reduction can be adjusted.

Figure 2:
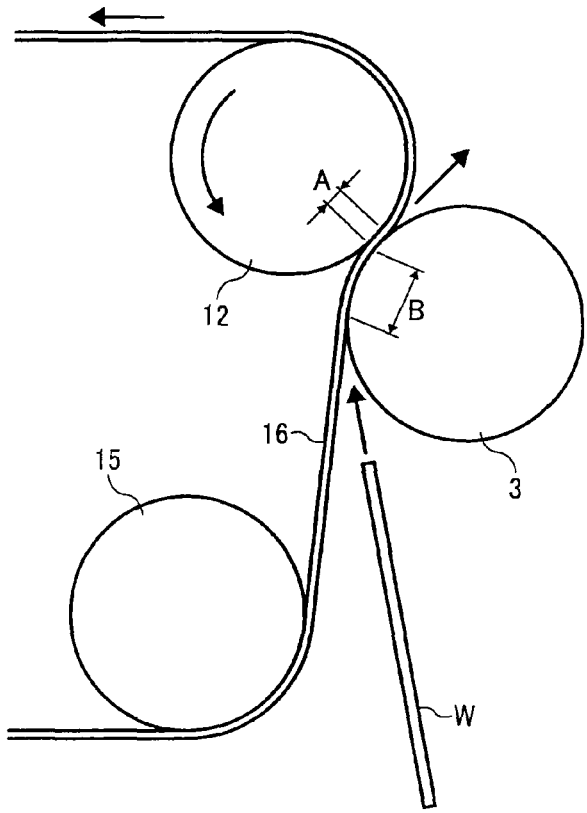
FIG. 2 is a partially enlarged view around a nip and a pre-nip when a sheet and an endless belt are not in contact with each other.

As shown in FIG. 2, the center of the axis of the pressure roller 3 is placed below the center of the axis of the driving roller 12. Moreover, the pressure roller 3 is rotatably supported to the machine frame so as to press the driving roller 12 interposing the endless belt 16 therebetween. Because the endless belt 16 and the driving roller 12 are pressed against each other and brought into contact with each other, a nip A of a required length that holds and conveys a sheet W is formed.

The pressure roller 3 is arranged so as to push the endless belt 16 stretched between the driving roller 12 and the lower support roller 15 arranged under the side of the driving roller 12 inwardly for a required length. Because the endless belt 16 is abutted to the pressure roller 3 for a required length, a pre-nip B of a required length is formed. The nip A and the pre-nip B are collectively called a nip portion. Depending on the position of the center of the axis of the pressure roller 3, the pre-nip B may not be formed. However, the present invention is also applicable in such an event.

In the holding and conveying unit formed in this manner, the endless belt 16 rotates anticlockwise by transmitting the rotation output of (the rotation axis of) the motor via the speed reduction mechanism formed by the small diameter gear 21 and the large diameter gear 11. The pressure roller 3 rotates along via the nip A and the pre-nip B. When the sheet W is brought into contact with the endless belt 16 at a predetermined position, the sheet W is caught and conveyed by the pre-nip B. Then, the sheet W is caught by the nip A continuously formed with the pre-nip B, and conveyed upwards by being held therebetween.

A rotary encoder 4, as shown in FIG. 1, is connected to an end of the axis of the lower support roller 15 arranged under the side of the driving roller 12. In the present embodiment, the rotary encoder 4 detects rotation information of the lower support roller 15, and the speed information of the endless belt 16 is detected from the rotation information. The rotary encoder 4 may be arranged on the left lower support roller 14. The position to fix the encoder with respect to each roller may be set arbitrarily, and the position is not limited to the position shown in FIG. 1.

Figure 3:
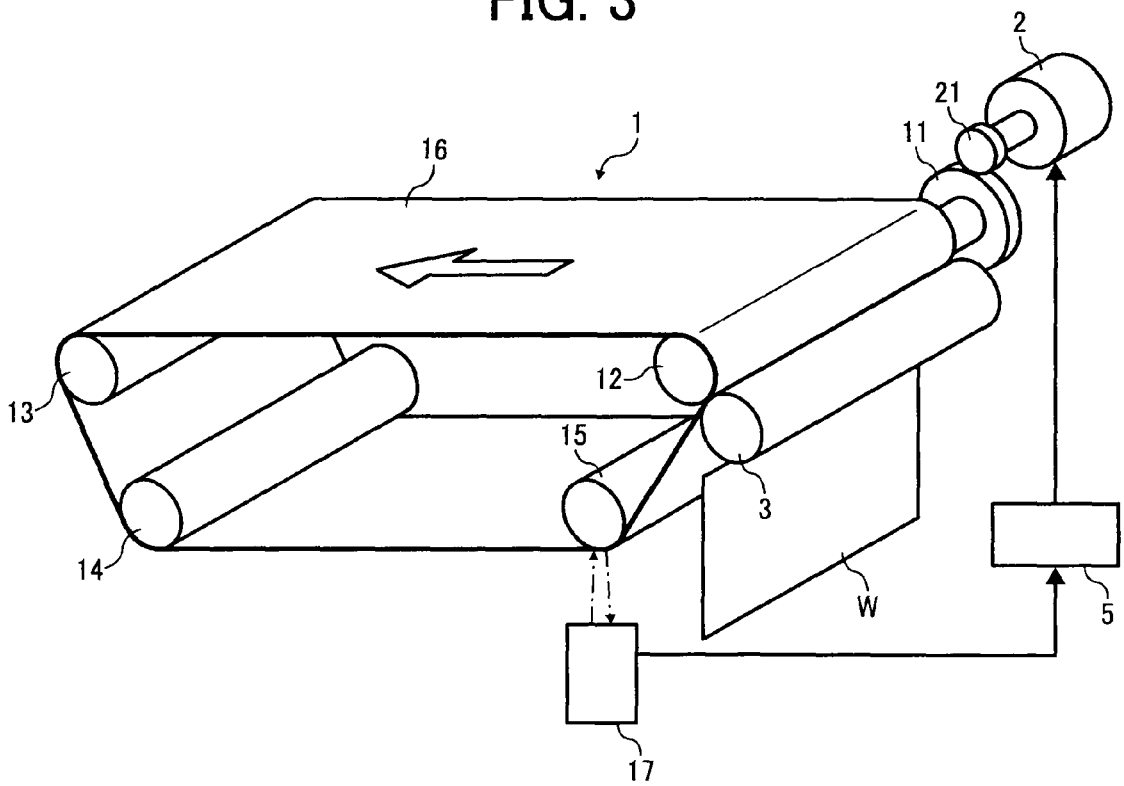
FIG. 3 is a schematic perspective view of the sheet conveying device according to the first embodiment when the speed of the endless belt is measured by using a laser Doppler meter.
Figure 4:
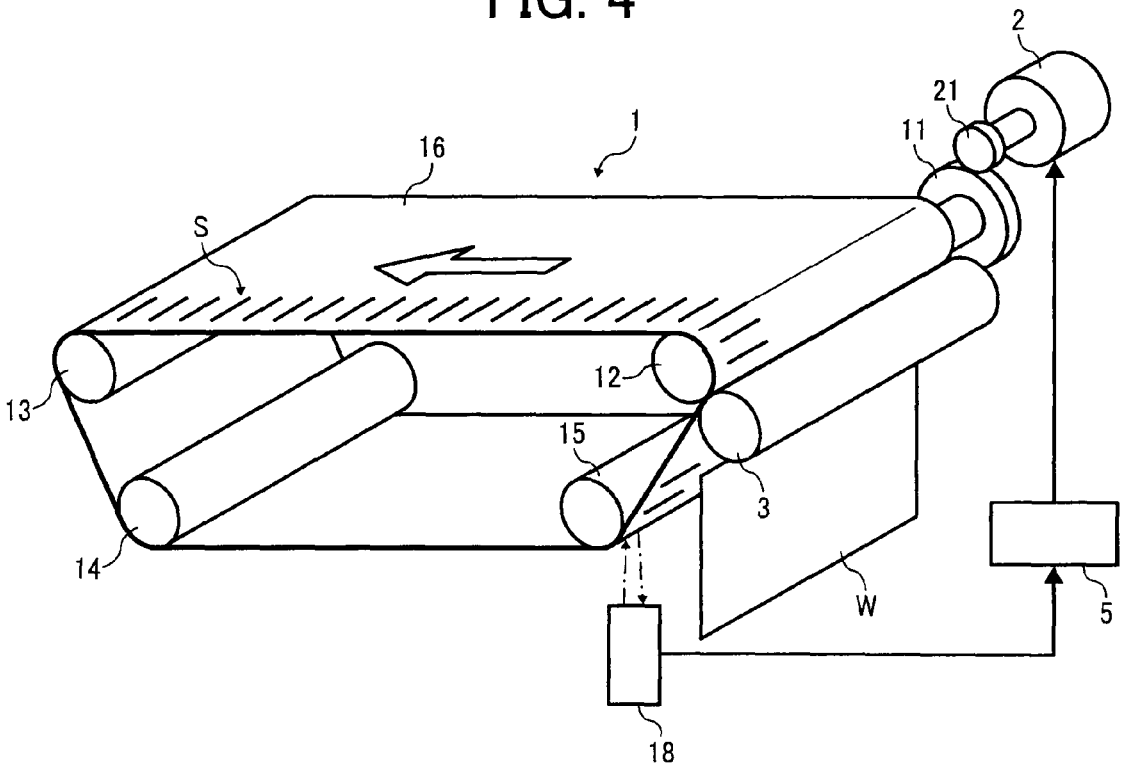
FIG. 4 is a schematic perspective view of the sheet conveying device according to the first embodiment when the speed of the endless belt is measured by using a surface scale applied on a surface of the endless belt and an optical sensor.

With a method of not using the rotary encoder, as shown in FIG. 3, a method of measuring the speed of the endless belt 16 using a laser Doppler meter 17 may be used. The measuring point may be different from the position shown in FIG. 3, but to acquire accurate measurement, it is preferable to measure at a portion where the endless belt 16 is adjoining with the roller and the like and where vibration does not tend to occur. The laser Doppler meter may be installed in the endless belt 16. As shown in FIG. 4, it is also preferable to measure the speed of the endless belt 16 by using a surface scale S applied on the surface of the endless belt 16 and an optical sensor 18. The surface scale S may be provided within (rear surface of) the endless belt 16.

Figure 5:
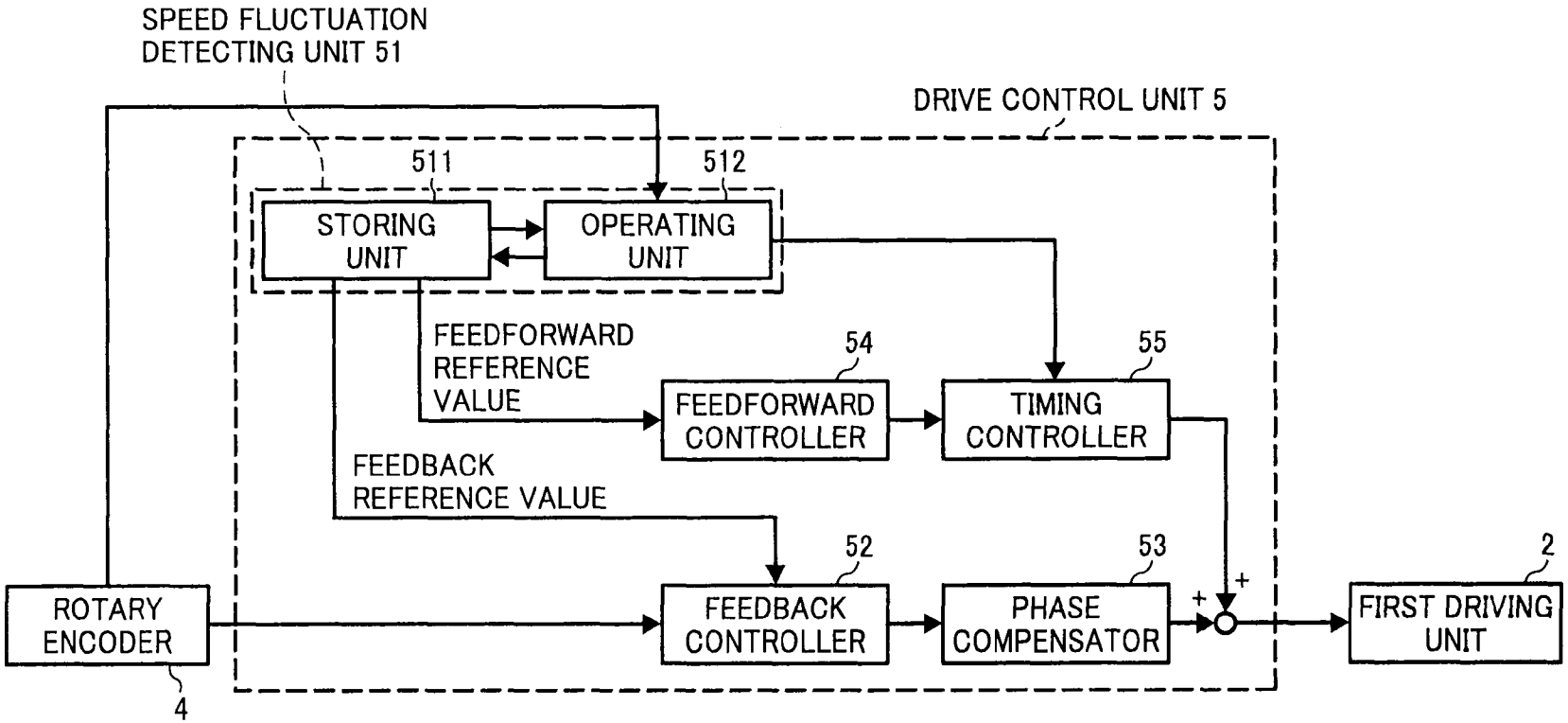
FIG. 5 is a block diagram of a correction control unit.

As shown in FIG. 5, the drive control unit 5 includes a speed fluctuation detecting unit 51, a feedback controller 52, a phase compensator 53, a feedforward controller 54, and a timing controller 55.

The speed fluctuation detecting unit 51 includes a storing unit 511 and an operating unit 512. The storing unit 511 stores therein a digitalized feedback reference value that can carry out a comparison operation between the designed rotation speed of the endless belt 16 (designed conveying speed of sheet W) and the speed information of the endless belt 16 obtained from the rotary encoder 4. The storing unit 511 also stores therein a feedforward reference value that digitalized the correction rotation speed (or correction torque) that corrects the rotation speed fluctuation of the endless belt 16 generated when the sheet W enters the nip portion. Moreover, a threshold that detects the speed fluctuation of the endless belt 16 generated when a tip of the sheet W is brought in contact with a predetermined position, a required conveying time (delay time) from the detection of the speed fluctuation to when the sheet W is conveyed to an entrance of the nip portion, and the like are stored in the storing unit 511. Among these, the feedforward reference value stores therein a plurality of values so as to correspond with each sheet W, because the speed fluctuation of the endless belt 16 at the entry of the nip portion differs by the thickness and the material of the sheet W.

The operating unit 512 indirectly detects whether the tip of the sheet W is brought into contact, by comparing the threshold and the speed information of the endless belt 16 obtained from the rotary encoder 4. When the speed of the endless belt 16 exceeds (or reaches) the threshold, or when the speed of the endless belt 16 falls short of (or reaches) the threshold, a speed fluctuation detection signal is output to the feedforward controller 54 and the timing controller 55. The speed fluctuation detection signal triggers the feedforward control. The rotary encoder 4 forms a fluctuation information acquiring unit, and the speed fluctuation detecting unit 51 forms a fluctuation detecting unit.

Figure 6:
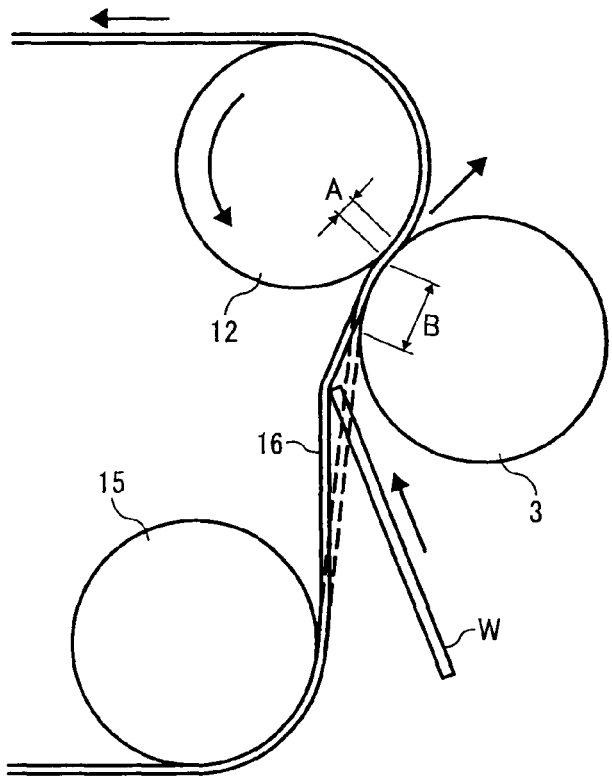
FIG. 6 is a partially enlarged view around a nip and a pre-nip when the sheet and the endless belt are in contact with each other.
Figure 7:
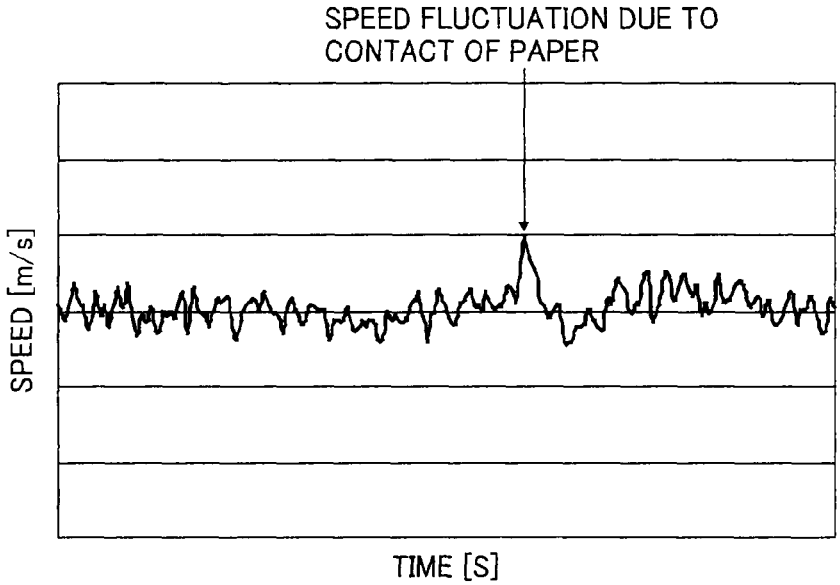
FIG. 7 is a graph of speed fluctuation of the endless belt.

The speed fluctuation generated when the sheet W is brought into contact with the endless belt 16 will now be explained with reference to FIGS. 6 and 7. FIG. 6 is a schematic of a behavior of the endless belt 16 when the sheet W is brought into contact with the endless belt 16. As shown in FIG. 6, when the sheet W is brought into contact with the endless belt 16, the sheet W pushes the endless belt 16 inwardly. Accordingly, the position of the endless belt 16 changes from a position C at the normal state shown in a broken line to a position D shown in a solid line. The speed fluctuation of the endless belt 16 at this time, measured by the rotary encoder fixed on the same axis as the lower support roller 15 is shown in FIG. 7. As shown in FIG. 7, the speed of the endless belt 16 is increased when the sheet W is brought into contact with the endless belt 16. By detecting the speed fluctuation, it is possible to detect that the sheet W is brought into contact with the endless belt 16. In other words, if the counting of the required conveying time (delay time) stored in the storing unit 511 is started, triggered by the detection of the speed fluctuation in FIG. 7, it is possible to estimate the timing when the sheet W enters the nip portion. In FIG. 6, a predetermined position is where the sheet W is brought into contact with the endless belt 16, and the predetermined position can be set arbitrarily. To reduce the fluctuation time from when the sheet W is brought into contact with the endless belt 16 to when the sheet W enters the nip portion, it is preferable to set the predetermined position close to the nip portion as much as possible. To keep the predetermined position from fluctuating, a member to guide the conveying path of the sheet W may also be installed.

Figure 8:
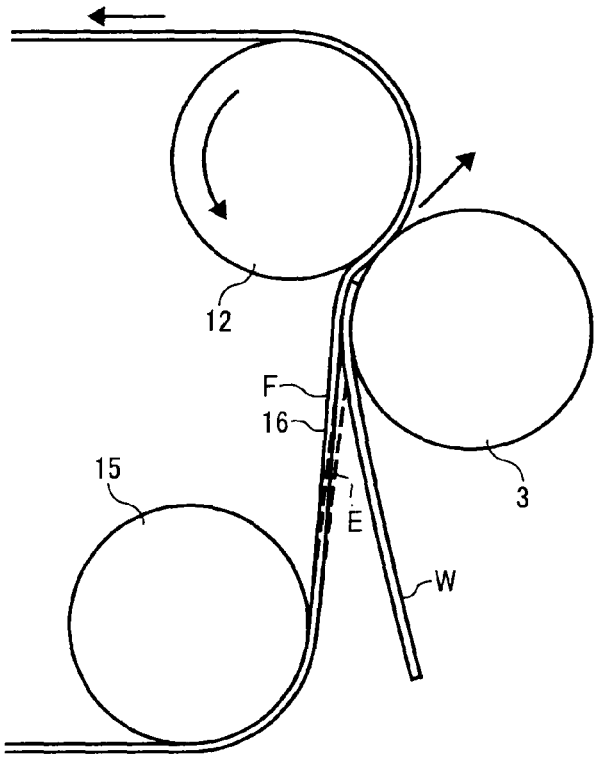
FIG. 8 is a partially enlarged view around a nip and a pre-nip after the sheet and the endless belt are in contact with each other.

The speed fluctuation generated when the sheet W enters the nip portion will now be explained with reference to FIGS. 2, 8, and 9. As shown in FIG. 2, the sheet W is conveyed towards the pre-nip B, and after the tip is brought into contact with the entrance of the pre-nip B, as shown in FIG. 8, the sheet W is caught and conveyed by the pre-nip B. The sheet W is then caught by the nip A, which is continuously formed with the pre-nip B, and conveyed upward by being held therebetween. In FIG. 8, a broken line E is the stretched position of the endless belt 16 at the normal state and a solid line F is the stretched position of the endless belt 16 when the sheet W enters the pre-nip B. Because the sheet W pushes the endless belt 16 inwardly when the sheet W enters the pre-nip B, the stretched position of the endless belt 16 changes from E to F.

Figure 9:
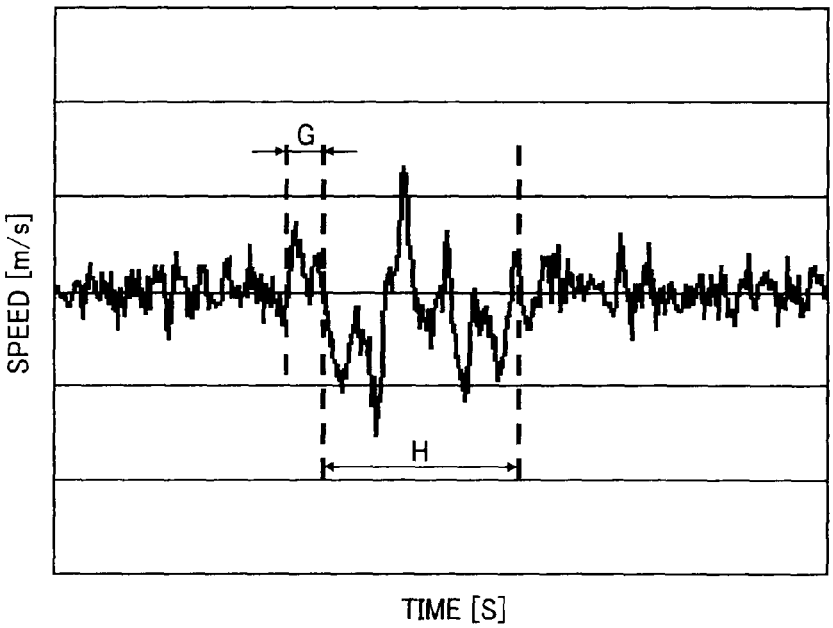
FIG. 9 is a graph of speed fluctuation of the endless belt.

FIG. 9 is a graph of the speed fluctuation generated when the sheet W enters the nip portion (pre-nip B and nip A). The speed fluctuation shown in FIG. 9 indicates the speed fluctuation of the endless belt 16 measured by the rotary encoder 4. The speed fluctuation of G in FIG. 9 is the speed fluctuation generated when the sheet W enters the pre-nip B. The speed fluctuation of H is the speed fluctuation generated when the sheet W enters the nip A. In this manner, when the sheet W enters the pre-nip B, the same phenomenon as when the sheet W is brought into contact with the endless belt 16 as explained in FIGS. 6 and 7 occurs. Therefore, the entry of the sheet W into the nip portion can be detected, by detecting the speed fluctuation generated when the sheet W enters the pre-nip B.

The feedback controller 52 compares the speed information from the rotary encoder 4 and the feedback reference value stored in the storing unit 511, calculates a drive command value so as to minimize the deviation (so as to converge to the feedback reference value), and performs the rotation control of the first driving unit 2 based on the drive command value. The drive command value differs according to the type of the motor (such as brushless DC motor, pulse motor, ultrasonic motor, and direct drive motor) that is the first driving unit 2. When the drive source includes a function of outputting the speed signal according to the rotation speed, the rotation control of the drive source may be carried out by giving feedback to the signal.

The phase compensator 53 compensates a gain margin and a phase margin, compensates an oscillation generated when the phase of the amplifier circuit itself exceeds 180 degrees, appropriately maintains gain frequency characteristics, and stabilizes the feedback control.

The feedforward controller 54 converts the feedforward reference value stored in the storing unit 511 to the drive command value. In other words, with respect to the speed fluctuation (G and H in FIG. 9) of the endless belt 16 generated when the sheet W enters the nip portion, the feedforward reference value formed so as to negate the speed fluctuation is converted into the drive command value to carry out the rotation control of the first driving unit 2.

Figure 10:
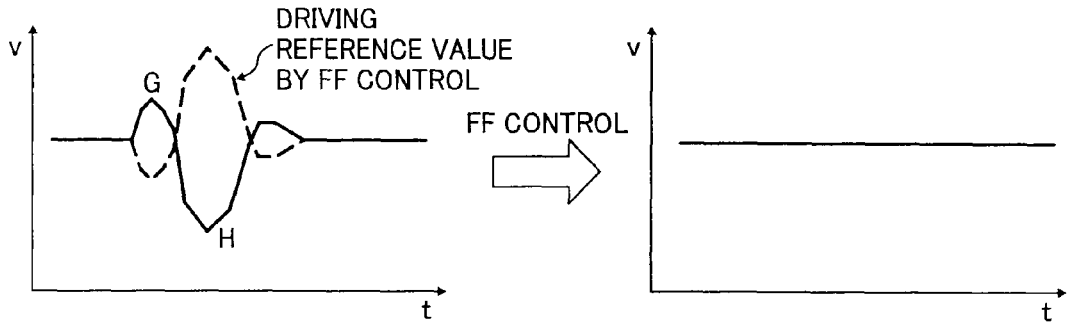
FIG. 10 is an explanatory diagram of the concept of feedforward control.

The feedforward reference value is formed by speed data of which the reference conveying speed (designed conveying speed) of the endless belt 16 is subtracted from the speed information of the endless belt 16 when the sheet W is caught by the endless belt 16, and multiplied by −1. The feedforward controller 54 is formed by an inverse function of the transfer function from the drive command value to the first driving unit 2, to the conveying speed of the endless belt 16. FIG. 10 is an explanatory diagram of a concept of the feedforward control that simplified the speed fluctuation shown in FIG. 9. In FIG. 10, the solid line shows the speed fluctuation when the sheet W enters the nip portion, and the broken line shows a driving reference value by the feedforward control. Carrying out the actual feedforward control makes it possible to negate the speed fluctuation generated when the sheet W enters the nip portion as shown in FIG. 10.

The timing controller 55 includes a delay circuit of which the counting of the required conveying time stored in the storing unit 511 is started, triggered by a speed fluctuation detection signal output from the operating unit 512, and executes the rotation control of the first driving unit 2 by the feedforward controller 54 at the time up. An entry timing estimating unit includes the timing controller 55 and the speed fluctuation detecting unit 51. The correction control unit includes the feedforward controller 54, the timing controller 55, and the first driving unit 2.

Figure 11:
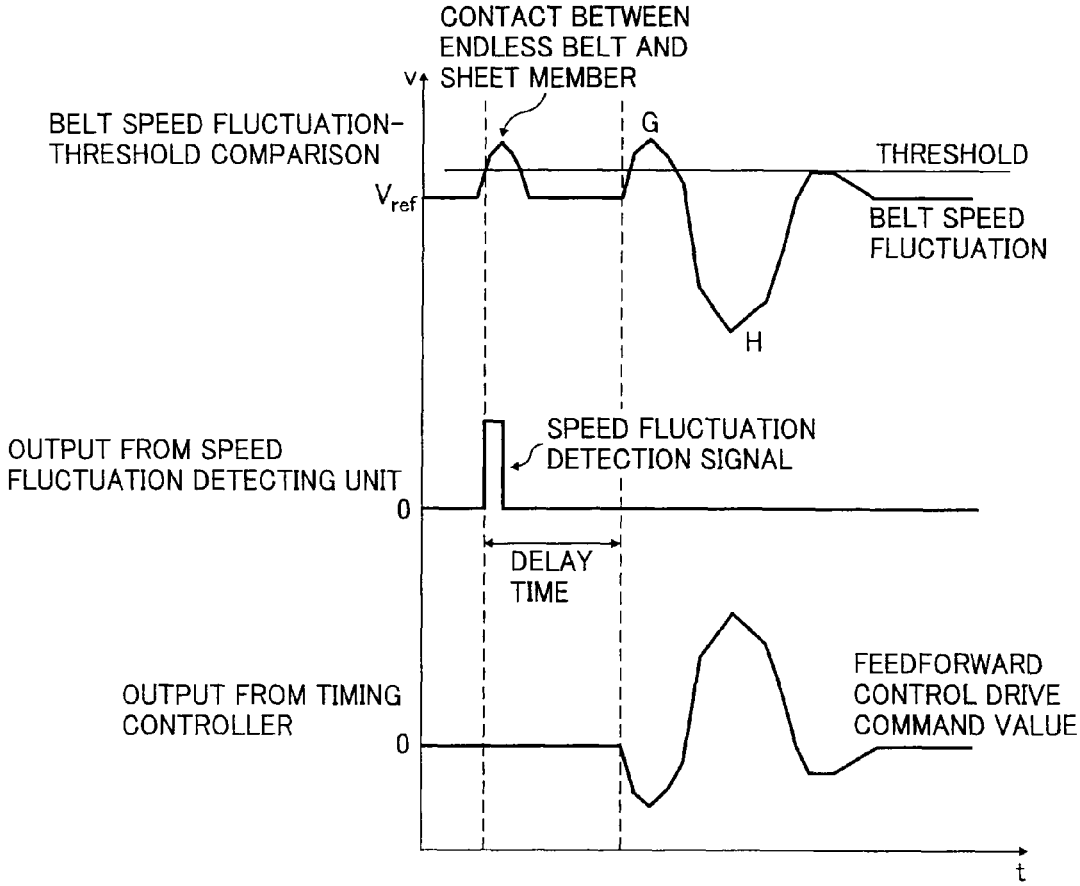
FIGS. 11 to 13 are timing charts of the feedforward control.

A series of operations of the sheet conveying device according to the first embodiment formed as the above will now be explained with reference to FIG. 11. To clarify the explanation, the belt speed fluctuation shown in FIG. 11 is shown by simplifying the waveform of the belt speed fluctuation shown in FIGS. 7 and 9. First, to make the nip portion convey the sheet W, start driving the first driving unit 2, and rotate the endless belt 16 spread across a plurality of rollers anticlockwise. With the rotation of the endless belt 16, the pressure roller 3 rotates along via the nip portion (nip A and pre-nip B).

The rotation of the endless belt 16 is stabilized by the feedback control of the feedback controller 52, so as to maintain the designed rotation speed (designed conveying speed of the sheet W by the nip portion) of the endless belt 16.

Then, the sheet W is fed in so as the tip of the sheet W is brought into contact with a predetermined position. The stretched position of the endless belt 16 changes, because the sheet W is brought into contact with the predetermined position. This arrangement speeds up the rotation speed of the endless belt 16 a little, and the speed information from the rotary encoder 4 changes accordingly.

As shown in FIG. 11, when the operating unit 512 determines that the change has reached (or exceeded) the threshold, the operating unit 512 outputs a speed fluctuation detection signal to the feedforward controller 54 and the timing controller 55. The feedforward controller 54 that received the speed fluctuation detection signal generates a drive command value from the feedforward reference value that corresponds to the sheet W to be conveyed. The timing controller 55 that received the speed fluctuation detection signal starts counting the required conveying time, triggered by the speed fluctuation detection signal.

The feedforward reference value that corresponds to the sheet W to be conveyed is selected from a plurality of feedforward reference values stored in the storing unit 511 in advance, in liaison with a paper selecting operation of an image forming apparatus main body side.

When the counting of the required conveying time has finished, the feedforward controller 54 executes the rotation control of the first driving unit 2 so as to negate the speed fluctuation of the endless belt 16 generated when the sheet W enters the nip portion, based on the generated drive command value. By suppressing the fluctuation of the conveying speed generated when the sheet W enters the nip portion, the sheet W is conveyed upward at the normal conveying speed.

In this manner, in the sheet conveying device according to the first embodiment, the sheet W is brought into contact with the predetermined position, and the fluctuation detecting unit detects the speed fluctuation of the endless belt 16 generated at the entry. Because the counting of the required conveying time of the sheet W from the predetermined position to the entrance of the nip portion by the entry timing estimating unit is started, triggered by the detection of the speed fluctuation, the accurate timing for the feedforward control can be estimated repeatedly.

Because the feedforward controller 54 executes the rotation control to negate the speed fluctuation of the endless belt 16 generated when the sheet W enters the nip portion, based on the timing estimate, the nip portion can convey the sheet W at a consistent and steady conveying speed.

As described above, the same phenomenon occurs when the sheet W is brought into contact with the endless belt 16 and when the sheet W enters the pre-nip B. Accordingly, the feedforward control can be performed as shown in FIG. 11, by assuming the entry of the sheet W into the pre-nip B as the contact with the endless belt 16.

Figure 12:
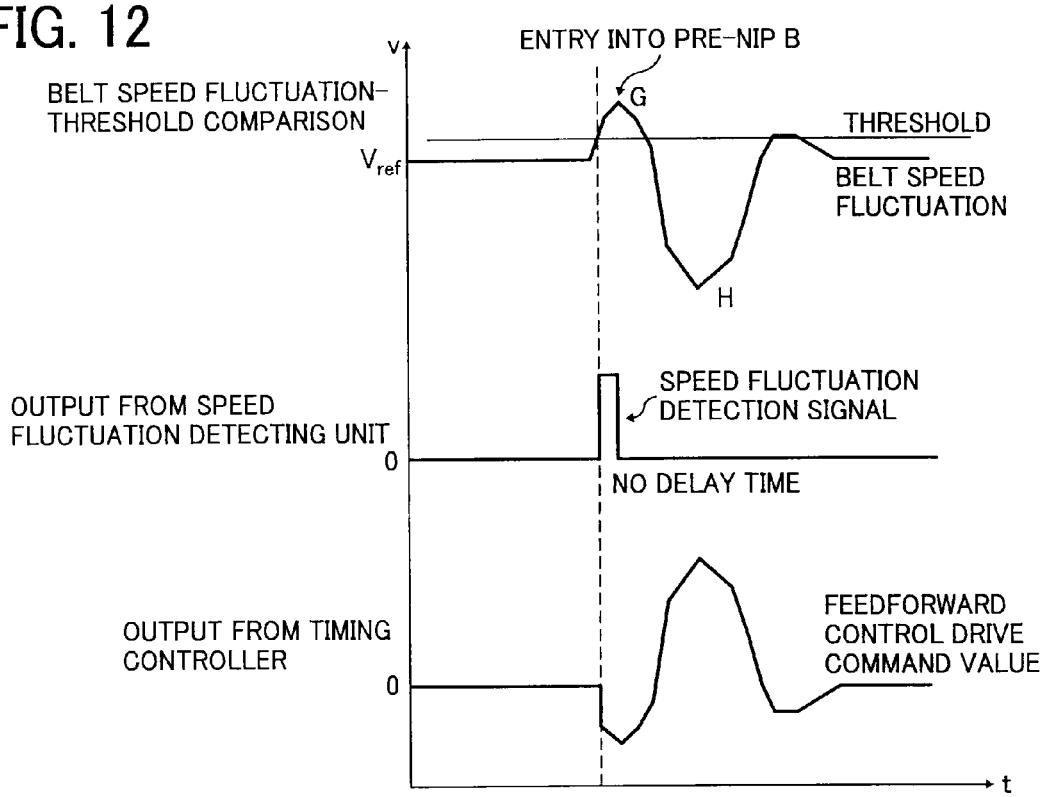

The method will be shown with reference to FIG. 12. The difference to FIG. 11 is that the speed fluctuation generated when the sheet W enters the pre-nip B is compared with the threshold. In FIG. 12, because the entry into the pre-nip B is the entry into the nip portion, the delay time is 0 seconds. As soon as the entry into the pre-nip B is detected, the feedforward controller 54 generates a drive command value from the feedforward reference value that corresponds to the sheet W to be conveyed. The rotation control of the first driving unit 2 will be executed, based on the generated drive command value.

Figure 13:
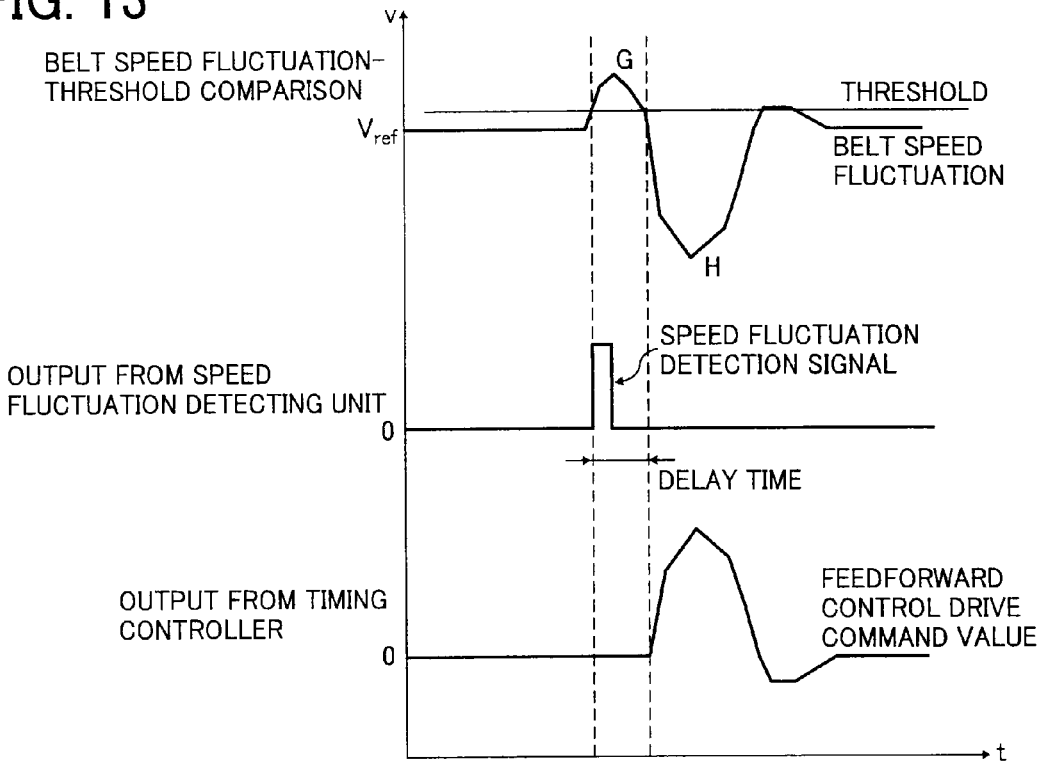

In this manner, with the configuration that includes the pre-nip B, the similar advantage of the feedforward control can be achieved, without intentionally bringing the sheet W into contact with the endless belt 16. Because the position of the pre-nip B is determined automatically, the predetermined position where the sheet W and the endless belt 16 are brought into contact with each other is highly stabilized. Therefore, it is possible to execute the feedforward control at a reliable timing every time. When the operation speed of the drive control unit 5 is not fast enough in the method shown in FIG. 12, the delay occurs from when the entry into the pre-nip B is detected to when the feedforward control is executed. Accordingly, there are possibilities such as the advantage of the feedforward control cannot be obtained sufficiently and amplifying the original fluctuation. In this case, a method shown in FIG. 13 can be used. In FIG. 13, the required conveying time from when the sheet W enters the pre-nip B to when the sheet W enters the nip A is stored in advance, and the counting of the required conveying time may be started, triggered by the detection time of the speed fluctuation caused when the sheet W enters the pre-nip B. Accordingly, in the method shown in FIG. 13, the feedforward control of the speed fluctuation of G generated when the sheet W enters the pre-nip B is not executed, but only the speed fluctuation of H generated when the sheet W enters the nip A will be suppressed by the feedforward control. Because the speed fluctuation of G is small compared with the speed fluctuation of H, it is possible to obtain sufficient control effect just by suppressing the speed fluctuation H.

By applying these sheet conveying devices to a transferring unit that uses an intermediate transfer belt and to a fixing unit that uses a fixing belt in electrophotographic image forming apparatuses, the image quality can further be improved.

With the present embodiment, the means to detect the speed fluctuation is shown as the method to detect the contact between the sheet W and the endless belt 16, and the entry of the sheet W into the pre-nip B. However, the other examples such as a position fluctuation or an acceleration fluctuation may be detected.

Figure 14:
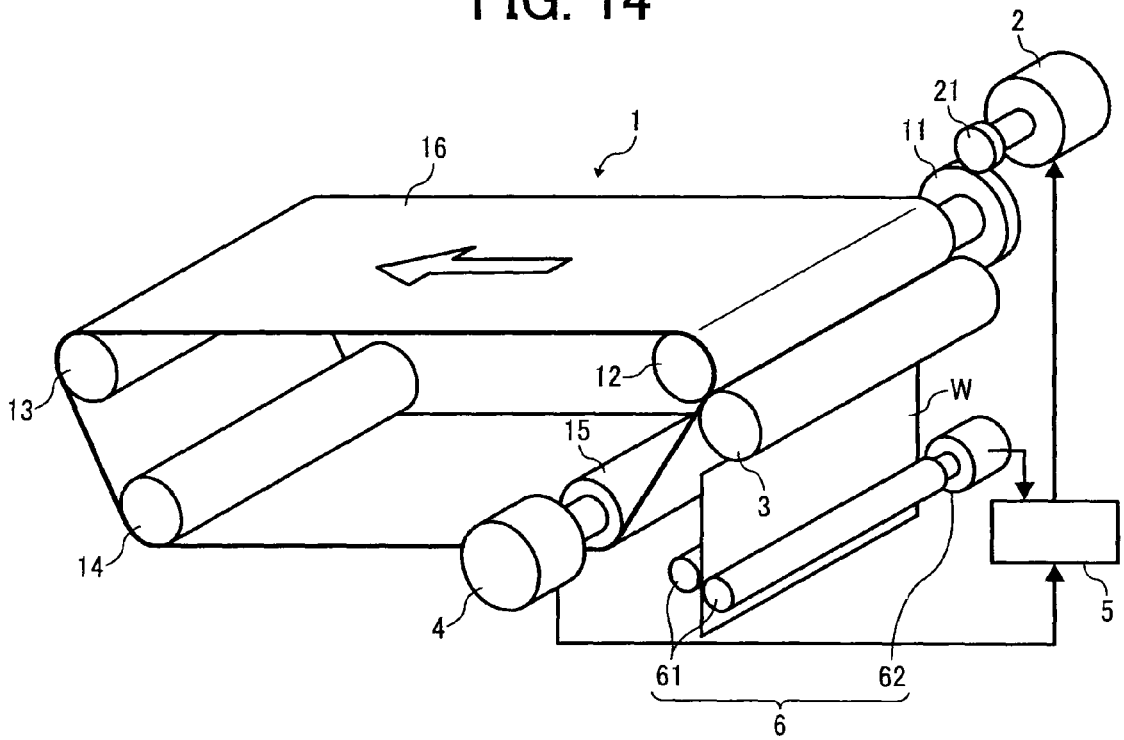
FIG. 14 is a schematic perspective view of a sheet conveying device according to a second embodiment of the present invention.

A sheet conveying device according to a second embodiment is added with a detection timing adjusting unit 6 that adjusts the comparison timing between the speed information of the endless belt 16 obtained from the rotary encoder 4, and the threshold to detect the contact between the sheet W and the endless belt 16, to the structure of the first embodiment. The structure that overlaps with the first embodiment is denoted by the same reference numerals, and the descriptions thereof are omitted. In other words, the detection timing adjusting unit 6, as shown in FIG. 14, includes a pair of conveying rollers 61 that convey the sheet W towards the pre-nip B, a drive source (not shown) that gives rotating drive force to the conveying rollers 61, an electromagnetic clutch 62 set between the drive source and the conveying rollers 61 and transmits and shields the rotating drive force of the drive source to the conveying rollers 61, and a control unit that controls the clutch operation of the electromagnetic clutch 62.

Figure 15:
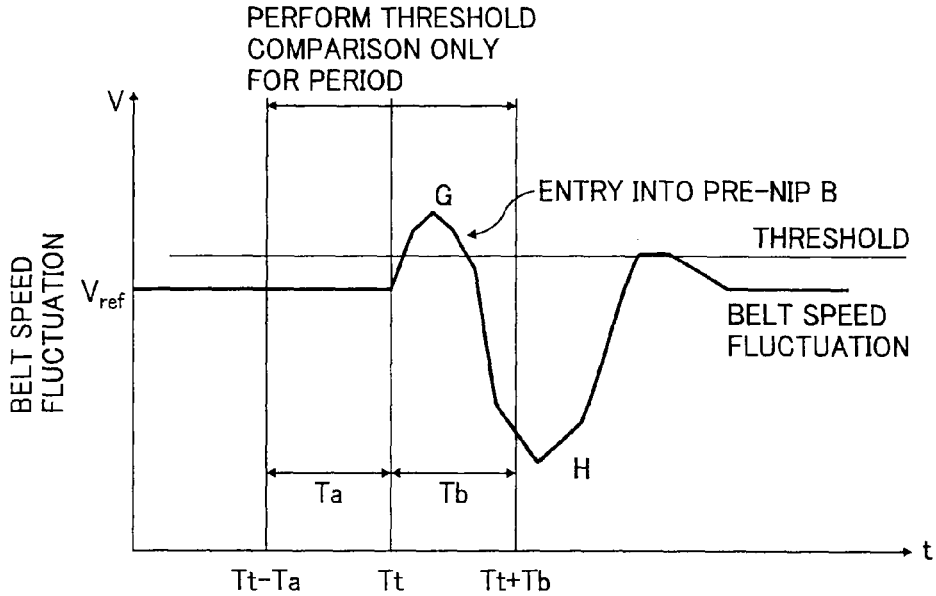
FIG. 15 is a timing chart of the feedforward control when the start and the end of a threshold comparison are performed at the timing stored in advance.

The control unit carries out the start and the end of the threshold comparison to detect the contact between the sheet W and the endless belt 16 at the timing stored in advance. This operation will be explained with reference to FIG. 15. A required conveying time Tt from when the conveyance of the sheet W starts by linking the electromagnetic clutch 62 until when the sheet W enters the nip portion is calculated or experimentally obtained in advance. Then, the threshold comparison is carried out only for the period between Tt−Ta and Tt+Tb as shown in FIG. 15. The control unit stores therein Tt−Ta and controls the timing to start the threshold comparison, having the counting of Tt−Ta triggered by the power supply to the electromagnetic clutch 62. Tt+Tb may also be stored, thereby controlling the timing to end the threshold comparison. In this manner, by carrying out the threshold comparison only for a certain time, the speed fluctuation of the endless belt caused by the disturbance other than the contact of the sheet can be prevented from being falsely detected as the contact between the sheet W and the endless belt 16.

When Ta and Tb are increased, the effect to prevent the false detection decreases. When Ta and Tb are decreased, a safety ratio with respect to the fluctuation of Tt decreases. By considering these situations, the values of the Ta and Tb may be set appropriately. Instead of storing the end timing Tt+Tb of the threshold comparison, the control may be carried out by finishing the threshold comparison when the contact between the sheet W and the endless belt 16 is detected by the threshold comparison. In this case, only Tt−Ta may be stored. The operation of the electromagnetic clutch 62 may generate some errors to the operation start signal. However, this will not be a problem because of the usage.

Figure 16:
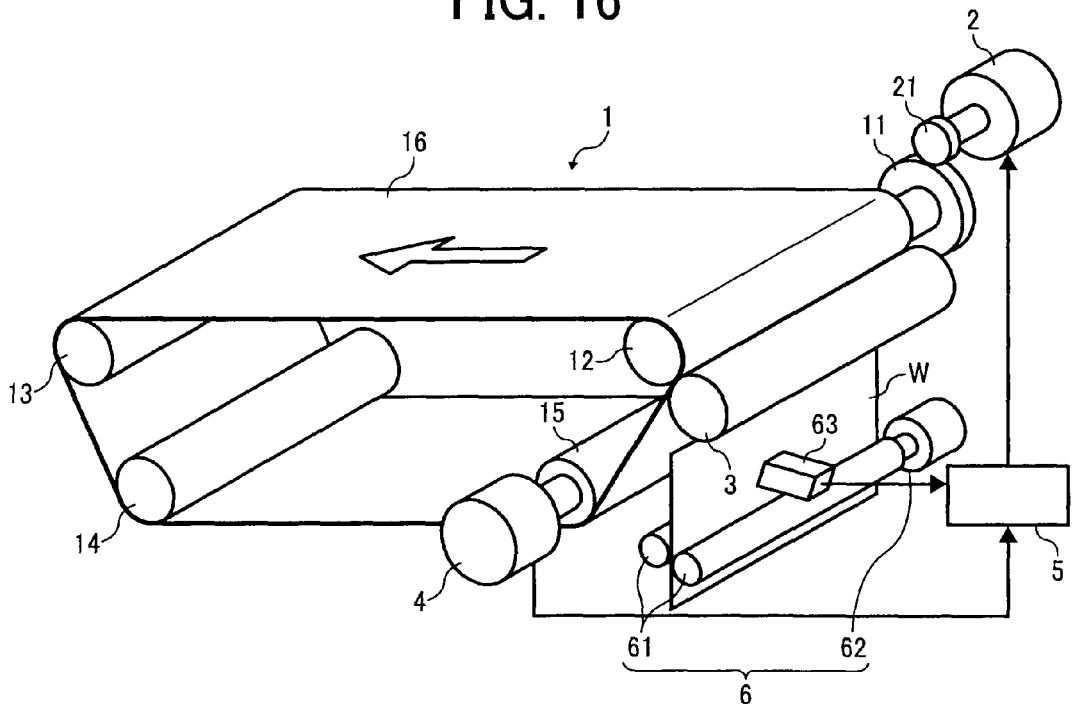
FIG. 16 is a schematic perspective view of the sheet conveying device according to the second embodiment when a sheet detection sensor is installed.

The configuration of using the electromagnetic clutch is described here. However, even with the configuration without the electromagnetic clutch, the start signal of the drive source, which is not shown, that drives the conveying rollers 61 may be used as a trigger. Moreover, as shown in FIG. 16, a sheet detecting sensor 63 may be installed separately and may be used, triggered by a sheet detection signal output from the sensor.

With the sheet conveying device according to the second embodiment, the threshold comparison to detect the speed fluctuation of the endless belt 16 is carried out with the required and sufficient timing, thereby preventing the probability of the false detection. As a result, the more reliable timing estimate for the feedforward control can repeatedly be carried out, thereby enabling to carry out the conveyance of the sheet W at the consistent and steady conveying time.

Third Embodiment

Figure 17:
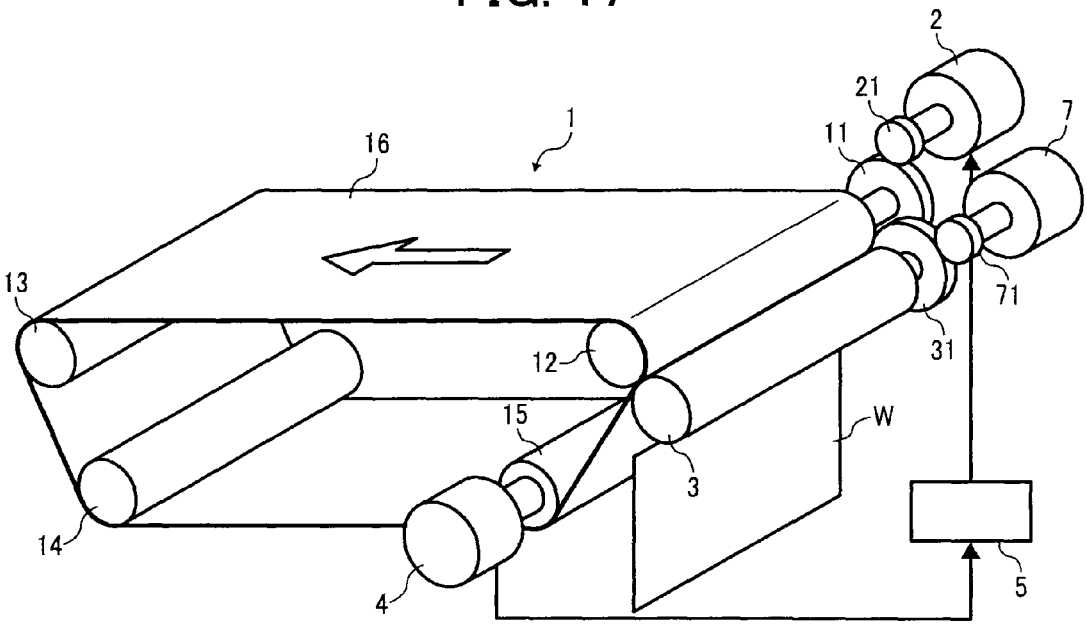
FIG. 17 is a schematic perspective view of a sheet conveying device according to a third embodiment of the present invention.

A sheet conveying device according to a third embodiment, as shown in FIG. 17, includes a second driving unit 7 that rotatably drives the pressure roller 3 (second roller), to the structure of the first embodiment (or second embodiment). The structure that overlaps with the first embodiment is denoted by the same reference numerals, and the descriptions thereof are omitted.

The second driving unit 7 is a motor supported to the machine frame and electrically connected to the drive control unit 5. The rotation output from the second driving unit 7 is transmitted to the pressure roller 3, via a speed reduction mechanism that includes a small diameter gear 71 fixed to the rotation axis of the motor, and a large diameter gear 31 meshed with the small diameter gear 71 and fixed to an end of the pressure roller 3.

The sheet conveying device according to the third embodiment formed in this manner completely removes the possibility of generating a glide caused by being rotated, by rotatably driving both the driving roller 12 and the pressure roller 3, and holding the sheet W therebetween. Accordingly, the time from when the sheet W enters the pre-nip B to when the sheet W enters the nip A can be stabilized. As a result, the speed fluctuation caused when the sheet W enters the nip portion can be stabilized, thereby enabling to obtain the advantage of the feedforward control steadily and repeatedly.

Similar to the first driving unit 2, the type of the motor and the speed reduction mechanism are not particularly limited. The configuration may be made by separating the rotation drive force of the first driving unit 2. This configuration is preferable due to the low cost.

Fourth Embodiment

A sheet conveying device according to a fourth embodiment includes a feedforward reference value producing unit that produces a feedforward reference value, based on the speed fluctuation of the endless belt generated to the nip portion when the sheet is conveyed. The reason to include the feedforward reference value producing unit is as follows:

With the sheet conveying device, even when the same type of the paper is used, the speed fluctuation of the belt generated when the paper enters the nip portion changes, depending on the usage environment and the individual variety of the machine to be used. Therefore, the optimal control effect may not be achieved, when the feedforward reference value set in advance is used.

Figure 18A:
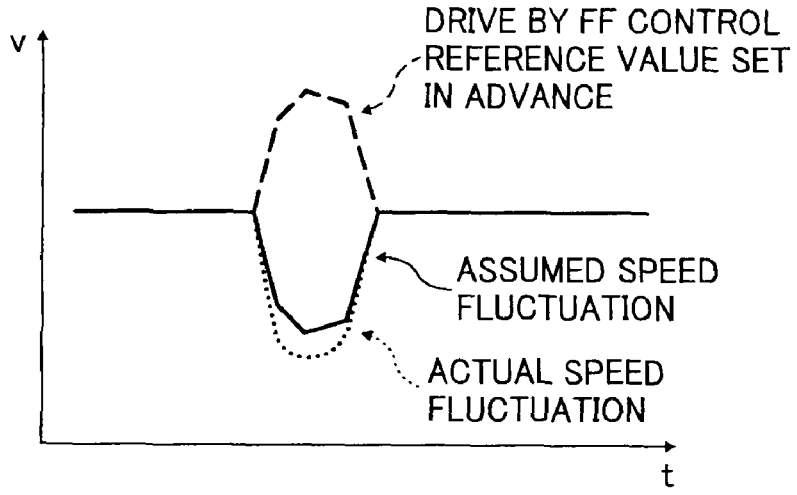
FIGS. 18A and 18B are explanatory diagrams of a problem when a feedforward reference value is not corrected.
Figure 18B:
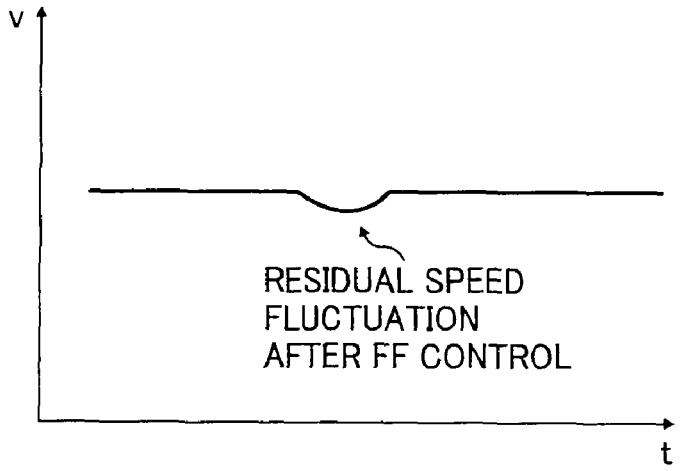

An example will now be explained with reference to FIGS. 18A and 18B. As shown in FIG. 18A, when the difference exists in the amplitude between the assumed speed fluctuation (solid line) and the actual speed fluctuation (dotted line), the speed fluctuation still remains as shown in FIG. 18B, even when the feedforward control is carried out by using the feedforward reference value (broken line) set in advance, based on the assumed speed fluctuation. The difference not only occurs to the amplitude between the assumed speed fluctuation and the actual speed fluctuation, as shown in FIGS. 18A and 18B, but the difference also occurs to the time duration of the speed fluctuations. Or, the difference may occur to both the amplitude and the time duration. In these cases, a problem occurs that the advantage of the feedforward control decreases, as when the difference occurs only to the amplitude.

To solve the problem, the sheet conveying device according to the fourth embodiment includes a feedforward reference value producing unit as explained in the following:

To correct the feedforward reference value set in advance

Figure 19A:
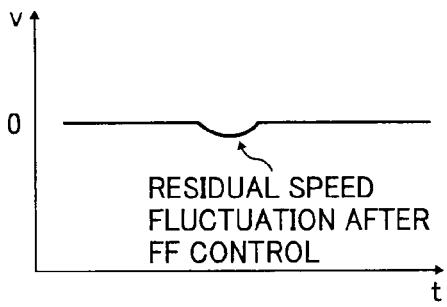
FIGS. 19A to 19D are explanatory diagrams of a method of correcting a feedforward reference value in a fourth embodiment of the present invention.
Figure 19B:
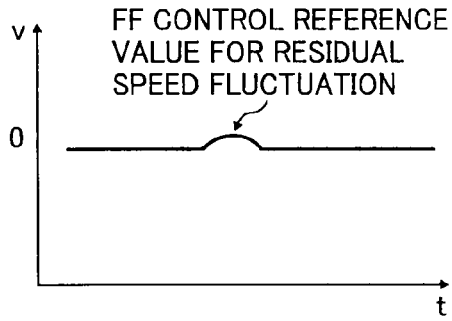
Figure 19C:
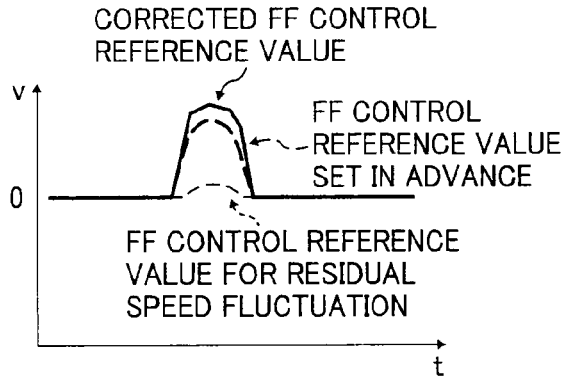
Figure 19D:
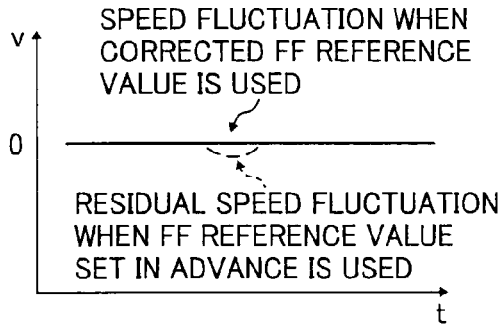

The correction method will be explained with reference to FIGS. 18A and 18B, and 19A to 19D. As shown in FIG. 18, when the difference exists between the assumed speed fluctuation and the actual speed fluctuation, the speed fluctuation remains after the feedforward control (FIGS. 18B and 19A). Therefore, as shown in FIG. 19B, a feedforward reference value that negates the residual speed fluctuation is calculated, and as shown in FIG. 19C, by adding the calculated feedforward reference value to the feedforward reference value set in advance, the optimal advantage of the feedforward control can be obtained when the sheet is fed through after the next time.

The calculation of the feedforward reference value that negates the residual speed fluctuation may be made by obtaining the relationship between the drive command value to the drive source and the belt speed in advance, and calculated by using the relational expression. For example, calculate a transfer function between the drive command value to the drive source and the belt speed in advance, store the inverse function in the storing unit, calculate the feedforward reference value from the obtained belt speed fluctuation information and the inverse function, and add the calculated feedforward reference value to the feedforward reference value set in advance. The calculation of the correction reference value may be carried out to a batch of the residual speed fluctuation, or to an average of a plurality of residual speed fluctuations. By carrying out the correction based on the average residual speed fluctuation, it is possible to prevent the excessive correction of the feedforward reference value with respect to the sudden speed fluctuation.

The corrected feedforward reference value may overwrite the feedforward reference value set in advance, and the corrected feedforward reference value may be used when the apparatus is used the next time. Or, the corrected feedforward reference value may be stored in a first memory, and the feedforward reference value set in advance may be used again at the next start-up.

The correction method of the feedforward reference value when the difference is only generated to the amplitude of the speed fluctuation is explained. However, the feedforward reference value may be corrected using the similar method, even when the difference is generated to the time duration of the speed fluctuation, or when the difference is generated both to the amplitude and the time duration.

The feedforward reference value may be corrected, for example, at every conveyance of a sheet, or at every conveyance of a plurality of sheets, or at a predetermined time set in advance. When the correction function is executed at the every conveyance of sheets, the correction may be carried out by using the speed fluctuation information at the conveyance of the sheet, immediately before the correction function is executed. Or, the correction may be carried out by using the average speed fluctuation information of the sheets, and the form is not particularly limited.

To generate a reference value without setting a feedforward reference value in advance In FIG. 18, the feedforward reference value set in advance is corrected by using the speed fluctuation control result after carrying out the actual feedforward control is explained. In this method, because the correction result of the feedforward reference value is only reflected to the actual control at least from the second image formation onwards, the advantage is not reflected when the first image is formed.

Figure 20A:
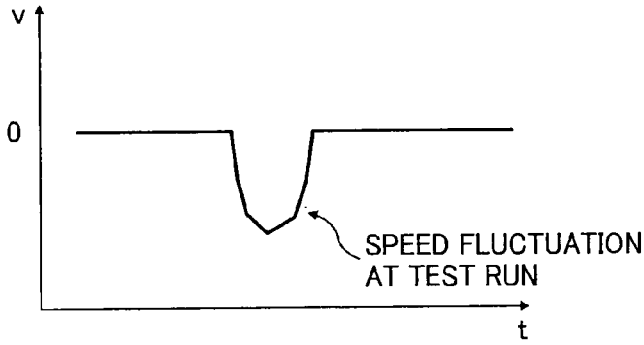
FIGS. 20A to 20D are explanatory diagrams of a method of producing the feedforward reference value in the fourth embodiment.
Figure 20B:
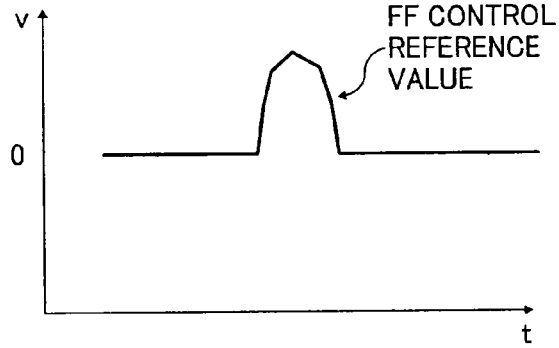
Figure 20C:
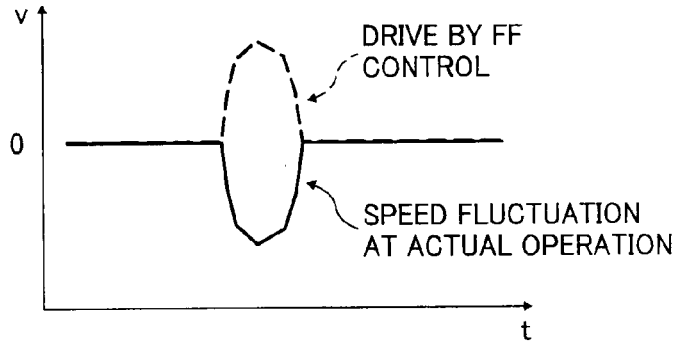
Figure 20D:
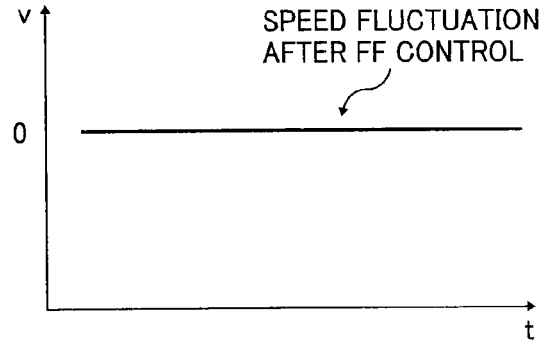

Accordingly, as shown in FIGS. 20A to 20D, a test run is performed immediately before the actual image formation. The speed fluctuation is measured when the sheet is being fed (FIG. 20A), thereby calculating the optimum feedforward reference value from the measured speed fluctuation (FIG. 20B). Accordingly, at the actual operation of the image formation, the optimum advantage of the feedforward control can be obtained (FIG. 20D), by carrying out the feedforward control by using the calculated feedforward reference value (FIG. 20B) as shown in FIG. 20C.

Similar to correcting the feedforward reference value set in advance, the feedforward reference value can be calculated by storing an inverse function of the transfer function between the drive command value to the drive source and the belt speed in the storing unit, and calculate the feedforward reference value from the obtained belt speed fluctuation information and the inverse function. It is preferable to calculate the feedforward reference value by using the average of the speed fluctuations, but the feedforward reference value may be calculated from a batch of the speed fluctuation information. When the usage environment and the usage conditions of the sheet conveying device are consistently maintained, it is possible to store the calculated feedforward reference value in the storing unit, and use the stored value when the apparatus is used the next time. When the usage environment and the usage conditions vary, it is preferable to calculate the feedforward reference value anew. Or, by combining with the method to correct the feedforward reference value set in advance, the feedforward control may be carried out by appropriately correcting the feedforward reference value. When this method is used, the feedforward reference values that correspond to a plurality of sheets do not need to be stored in advance, thereby enabling to reduce the capacity of the storing unit.

A sheet conveying device according to a fifth embodiment sets the rotary encoder that is the fluctuation information acquiring unit shown in the first embodiment, at the position different from the sheet conveying device according to the first embodiment. The structure that overlaps with the first embodiment is denoted by the same reference numerals, and the descriptions thereof are omitted.

Figure 21:
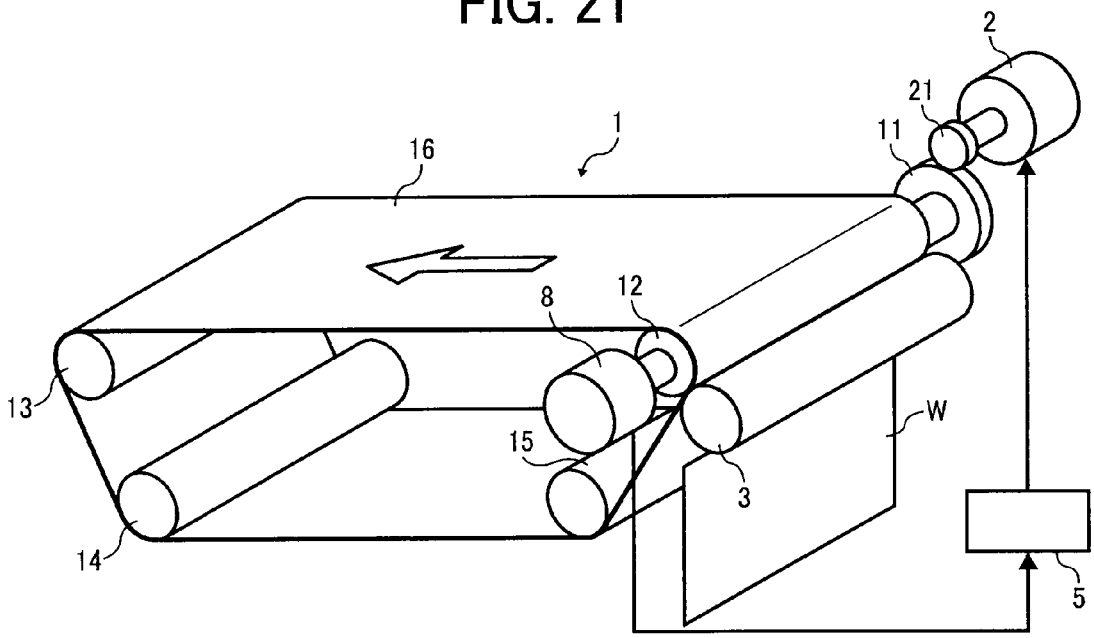
FIG. 21 is a schematic perspective view of a sheet conveying device according to a fifth embodiment of the present invention.

As shown in FIG. 21, in the fifth embodiment, a rotary encoder 8 is set to the end of the axis of the driving roller 12 as the fluctuation information acquiring unit. The rotary encoder 8 detects the rotation information of the driving roller 12, and the speed fluctuation of the endless belt 16 is detected from the rotation information. Here, the contact between the sheet W and the endless belt 16, and the entry of the sheet W into the pre-nip B are explained considered to be the same.

Figure 22:
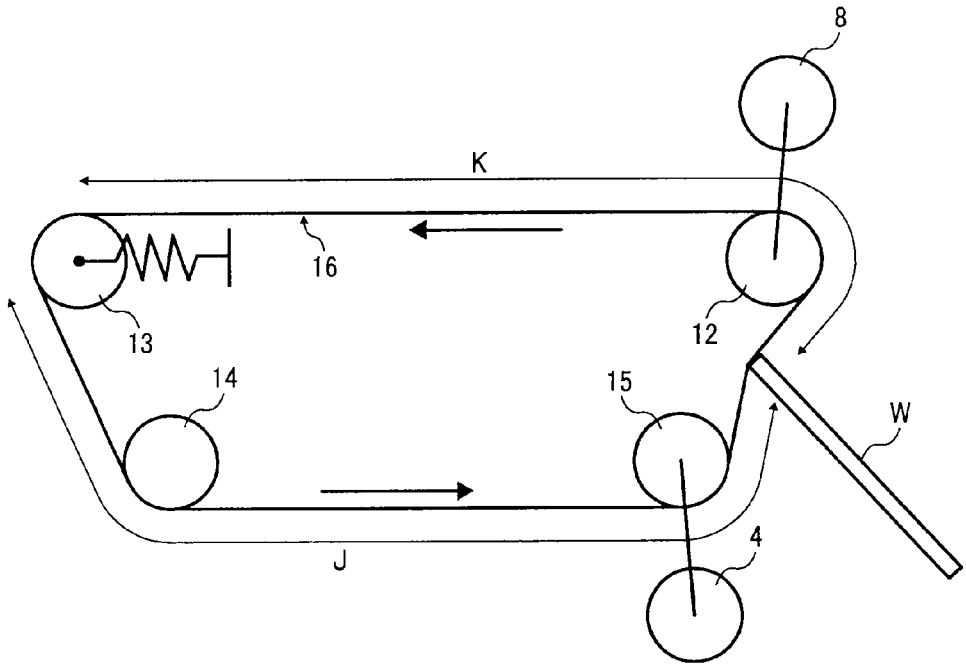
FIG. 22 is a schematic view of a sheet conveying device showing a segment J and a segment K.

As shown in FIG. 22, when the sheet W is brought into contact with a predetermined position of the endless belt 16, a phenomenon that the speed fluctuation generated to the endless belt 16 differs between a segment J and a segment K occurs. The segment J is between a predetermined position and the upper support roller 13 at the upstream side in a conveying direction of the endless belt 16, and the segment K is between a predetermined position and the upper support roller 13 at the downstream side in a conveying direction of the endless belt 16. The phenomenon occurs because, at the segment J, the endless belt 16 is pulled toward the conveying direction of the belt, whereas at the segment K, the endless belt 16 is pulled toward the reverse direction of the conveying direction of the belt.

The difference of the speed fluctuation generated between the segment J and the segment K will be absorbed when the position of the upper support roller 13 fluctuates. The upper support roller 13 is displaceably supported by the apparatus main body and biased by an elastic member in a direction that gives tension to the endless belt 16. The segment J and the segment K are divided by the predetermined position where the sheet W is brought in contact with the endless belt 16 and the upper support roller 13. Even when the configuration of the apparatus is different from the present embodiment, the segment J and the segment K may be defined by referring to the predetermined position and the position of the support roller that gives appropriate tension to the belt.

Figure 23:
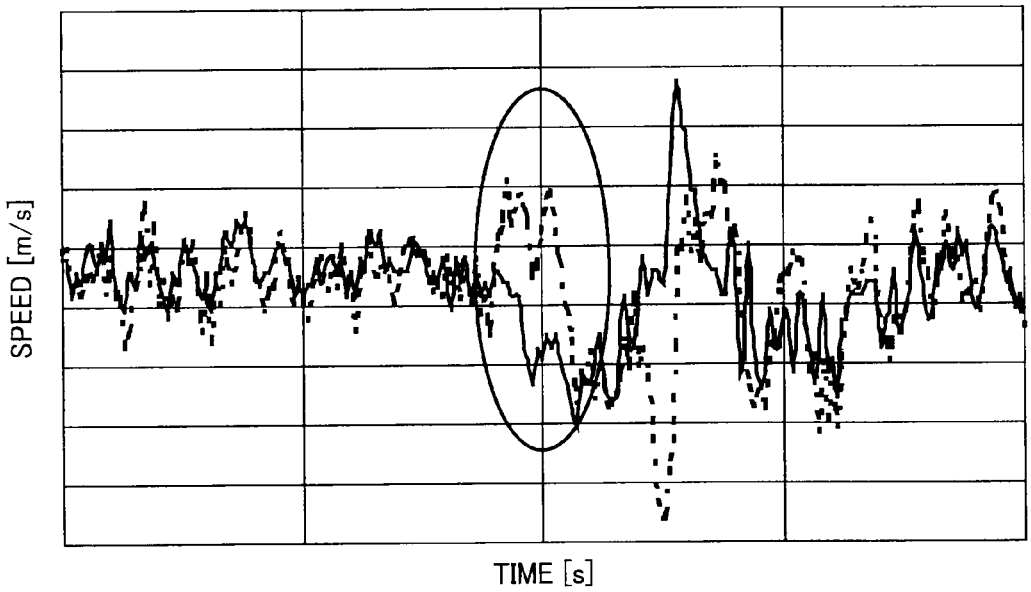
FIG. 23 is a graph of speed fluctuation of the endless belt when a sheet enters a nip portion.

In the first to the fourth embodiments, the speed fluctuation of the endless belt 16 at the section J is measured by the rotary encoder 4 set to the lower support roller 15. In the present embodiment, the speed fluctuation of the endless belt 16 at the section K is measured by the rotary encoder 8 set on the driving roller 12. In FIG. 23, the speed fluctuations of the endless belt 16 when the sheet W enters the nip portion, when the rotary encoder is set at the same position as the sheet conveying device according to the first embodiment, and when the rotary encoder is set at the same position as the sheet conveying device according to the present embodiment are shown. The broken line shows the speed fluctuation of the endless belt 16 measured by the rotary encoder 4 (segment J) set at the same position as the sheet conveying device according to the first embodiment. The solid line shows the speed fluctuation of the endless belt 16 measured by the rotary encoder 8 (segment K) set at the same position as the sheet conveying device according to the present embodiment. In this manner, it is clear to see that the speed fluctuation of the endless belt 16 differs by the position where the measurement is carried out (part surrounded by an ellipse in FIG. 23).

As shown in FIG. 23, the speed fluctuation of the endless belt 16 measured at the segment J (broken line in FIG. 23) is increased when the sheet W enters the pre-nip B, whereas the speed fluctuation of the endless belt 16 measured at the segment K (solid line in FIG. 23) is decreased. Therefore, a method of setting the threshold is different from the first embodiment, to measure the speed fluctuation of the endless belt 16 at the segment K and to detect the contact between the sheet W and the endless belt 16.

Figure 24:
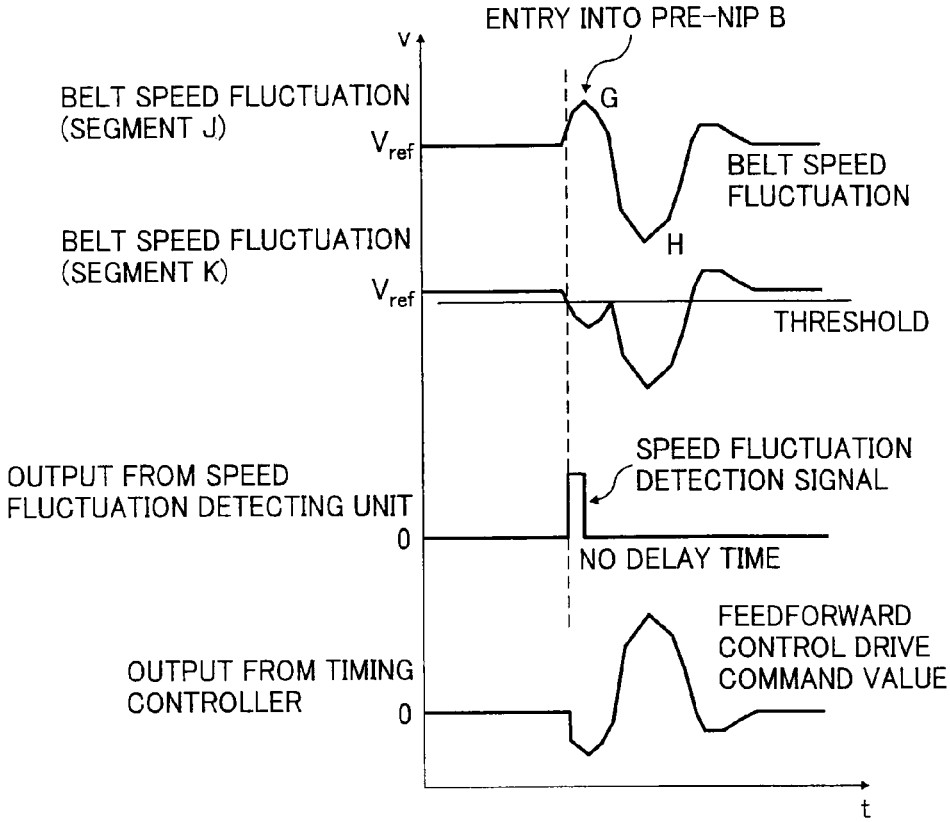
FIG. 24 is another timing chart of the feedforward control.

Feedforward control when the speed fluctuation of the endless belt 16 is measured at the segment K will now be explained with reference to FIG. 24. The waveforms shown in FIG. 24 are the simplified version of the actual waveforms. When the speed fluctuation of the endless belt 16 is measured at the segment K, the threshold needs to be set smaller than the steady rate of the endless belt 16, because the speed of the endless belt 16 decreases when the sheet W is brought into contact with the endless belt 16. Accordingly, in the present embodiment, when the operating unit 512 determines that the speed of the endless belt 16 reaches the threshold or falls short of the threshold (exceed in the speed reduction direction), it is determined that the sheet W is brought into contact with the endless belt 16. Because the method of the feedforward control is the same as the first embodiment, the descriptions thereof will be omitted.

The feedforward control command value shown in FIG. 24 is a command value to negate the speed fluctuation of the endless belt 16 at the segment J. The feedforward command value may appropriately be selected, depending on whether the speed fluctuation of the segment J or the segment K needs to be controlled. To suppress the speed fluctuation of the endless belt 16 at the segment K, the feedforward command value needs to be the command value to control the speed fluctuation of the segment K. At this time, the contact between the sheet W and the endless belt 16 may be detected, by using the speed fluctuation at the segment J, or by using the speed fluctuation at the segment K.

In a sheet conveying device according to a sixth embodiment, the fluctuation information acquiring unit includes a first information acquiring unit and a second information acquiring unit. The structure that overlaps with the first embodiment is denoted by the same reference numerals, and the descriptions thereof are omitted. The fluctuation information acquiring unit of the present embodiment calculates the difference between the speed fluctuation information acquired by the first information acquiring unit and the speed fluctuation information acquired by the second information acquiring unit, and detects the contact between the sheet W and the endless belt 16 from the difference data.

Figure 25:
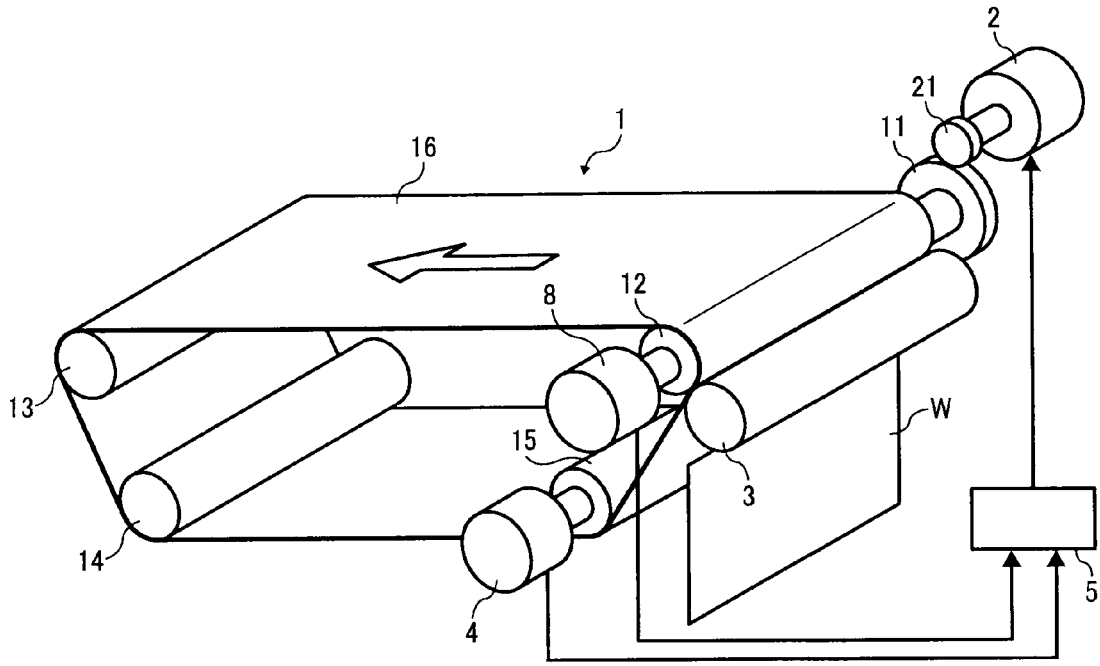
FIG. 25 is a schematic perspective view of a sheet conveying device according to a sixth embodiment of the present invention.

The first information acquiring unit, as shown in FIG. 25, includes the rotary encoder 4 shown in the first embodiment and detects the speed information of the endless belt 16 generated when the sheet W is brought into contact with the endless belt 16. The second information acquiring unit, as shown in FIG. 25, is the second rotary encoder 8 connected to the end of the axis of the driving roller 12. The second rotary encoder 8 detects the rotation information of the driving roller 12 and detects the speed fluctuation of the endless belt 16 from the rotation information. The operating unit that calculates the difference between the speed fluctuation information acquired by the first information acquiring unit and the speed fluctuation information acquired by the second information acquiring unit is incorporated in the drive control unit 5 in FIG. 25.

When the speed fluctuation of the endless belt 16 is measured by the rotary encoder 4 and the rotary encoder 8 will now be explained in detail with reference to FIGS. 23 and 26. The contact between the sheet W and the endless belt 16, and the entry of the sheet W into the pre-nip B are explained considered to be the same. As explained in the fifth embodiment, the speed fluctuation of the endless belt 16 differs between the segment J and the segment K. Particularly, when the sheet W is brought into contact with the endless belt 16, the speed of the endless belt 16 increases at the segment J, whereas the speed of the endless belt 16 decreases at the segment K. As shown in FIG. 23, the speed fluctuations of the endless belt 16 at the segment J and the segment K are approximately the same, before the sheet W is brought into contact with the endless belt 16. Therefore, the speed fluctuation generated when the sheet W is brought into contact with the endless belt 16 will be clarified, by taking the difference between the speed fluctuation of the endless belt 16 measured at the segment J, and the speed fluctuation of the endless belt 16 measured at the segment K. As a result, an advantage of removing noise at the period before the contact can be obtained.

Figure 26:
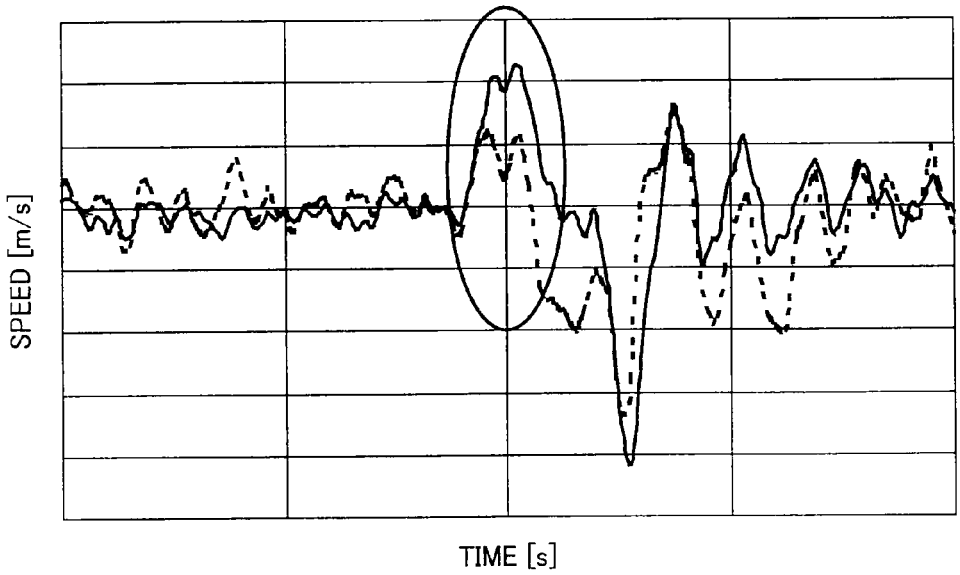
FIG. 26 is a graph of speed fluctuation of the endless belt respectively showing when the difference of the speed fluctuation is taken and when the difference of the fluctuation is not taken.

The speed fluctuations when the noise is removed and when the noise is not removed are shown in FIG. 26. The broken line shown in FIG. 26 is the speed fluctuation of the endless belt 16 measured by the rotary encoder 4. The solid line is data that the difference is taken between the speed fluctuations of the endless belt 16, measured respectively at the rotary encoder 4 and the rotary encoder 8. As shown in FIG. 26, the speed fluctuation generated when the sheet W is brought into contact with the endless belt 16 is more emphasized, with the data that took the difference. The amplitude of the vibration at the period before the contact is also reduced. By using the method, the level of the threshold can be set high, thereby increasing the safety ratio of the noise level at the steady state. As a result, the contact between the sheet W and the endless belt 16 can be detected without fail.

Figure 27:
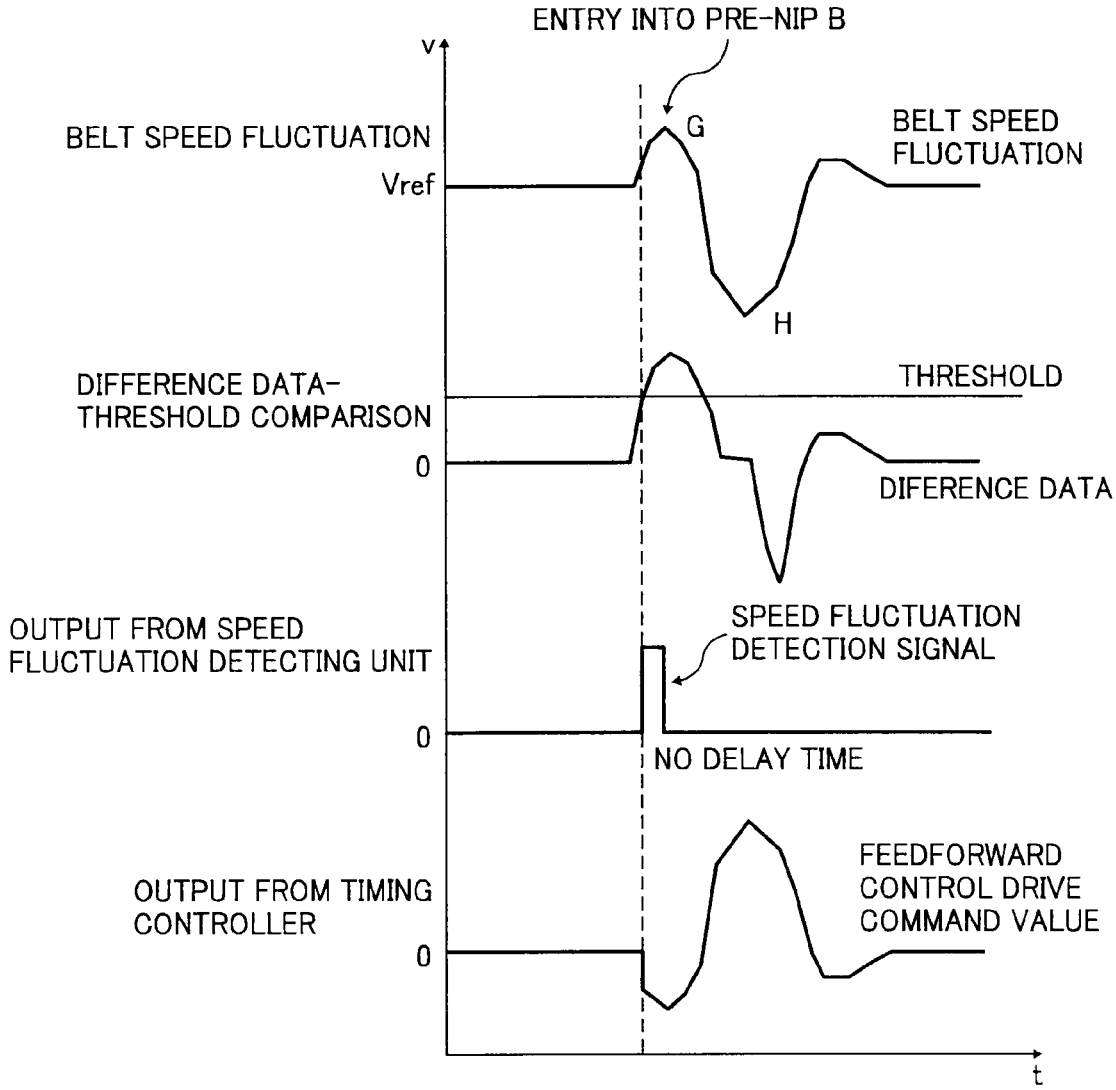
FIG. 27 is a timing chart of the feedforward control when the difference of the speed fluctuation is taken.

The feedforward control according to the present embodiment will now be explained with reference to FIG. 27. The difference of the speed fluctuations of the endless belt 16 obtained at the segment J and the segment K is taken, thereby comparing the difference data and the threshold. When the contact between the sheet W and the endless belt 16 is detected by the threshold comparison, the feedforward control may be carried out by the same method as shown in FIGS. 11, 12, and 13.

The sheet conveying device according to the sixth embodiment configured as the above clarifies the speed fluctuation generated when the sheet W enters the pre-nip B, thereby increasing detection accuracy. As a result, more reliable timing estimate of the feedforward control can be carried out repeatedly, thereby enabling to convey the sheet W at the consistent and steady conveying speed.

A sheet conveying device according to a seventh embodiment, when the drive force is applied to the endless belt 16 at the segment J or the segment K of the endless belt 16 explained in the fifth embodiment, measures the speed fluctuation of the drive source or a drive transmitting unit, as the speed fluctuation of the endless belt 16 at these segments. In the sheet conveying device according to the seventh embodiment, the speed fluctuation of the drive source 2 is measured without including the rotary encoder 8 that is the second information acquiring unit explained in the sixth embodiment. The structure that overlaps with the sixth embodiment is denoted by the same reference numerals, and the descriptions thereof are omitted.

Figure 28:
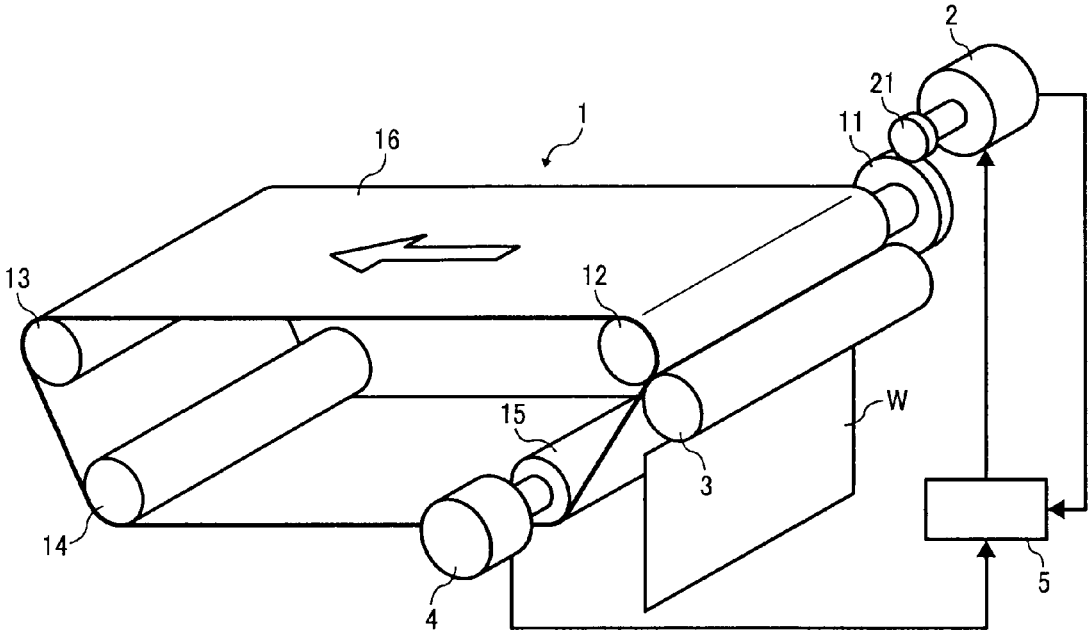
FIG. 28 is a schematic perspective view of a sheet conveying device according to a seventh embodiment of the present invention.

An example of the seventh embodiment will now be explained with reference to FIG. 28. In the endless belt 16 in FIG. 28, the segment K corresponds from around the nip portion of the driving roller 12 and the pressure roller 3 to the upper support roller 13. Because the driving roller 12 drives the endless belt 16, the drive force is applied at the segment K. At this time, the speed fluctuation generated when the sheet is brought into contact with the endless belt 16 reaches the drive source 2 via the driving roller 12, the large diameter gear 11, and the small diameter gear 21. In other words, the same speed fluctuation generated at the endless belt 16 is also generated at the large diameter gear 11, the small diameter gear 21, and the drive source 2. Accordingly, it is possible to substitute the speed fluctuation of the drive source 2, the small diameter gear 21, and the large diameter gear 11, as the speed fluctuation of the endless belt 16. Particularly, at the drive source 2, the electric signal based on the rotation speed can easily be acquired. Accordingly, the speed fluctuation of the endless belt 16 can be measured, without setting a rotary encoder anew. In FIG. 28, the drive force is applied at the segment K. However, the present invention is also applicable when the drive force is applied at the segment J.

In the sheet conveying device according to the seventh embodiment, the speed fluctuation of the endless belt 16 may be substituted by the speed fluctuation of the drive source 2. As a result, the freedom of apparatus design can be increased, thereby enabling to realize the sheet conveying devices according to the first to the sixth embodiments at low cost.

A sheet conveying device according to an eighth embodiment detects the thickness of the sheet W based on the fluctuation amount of the endless belt 16, and executes the rotation control of the first driving unit 2 based on the thickness of the sheet W. The contact between the sheet W and the endless belt 16, and the entry of the sheet W into the pre-nip B are explained considered to be the same.

The sheet conveying device according to the eighth embodiment, in addition to the functions shown in the first to the seventh embodiments, includes an operating unit and a storing unit. The operating unit calculates the maximum amplitude value of the corresponding portion or the integration value of the fluctuation amount, and indirectly detects the thickness of the sheet W from the calculated value. The calculation is made from the speed information of the endless belt 16 generated when the sheet W is brought into contact with the endless belt 16 (including the speed information being processed to acquire the difference). The storing unit stores therein a plurality of feedforward reference values based on the thickness of the sheet W. The operating unit and the storing unit are the modes that the corresponding functions are added to the operating unit 512 and the storing unit 511 explained in the first embodiment.

With the feedforward reference value, similar to the first embodiment, a plurality of values may be stored in the storing unit 511 in advance, so as to correspond to the thickness of each sheet W. Or, by using the reference value producing unit shown in the fourth embodiment, the feedforward reference value may be produced in advance or at the first conveying operation with each sheet W, and the produced feedforward reference values may be stored in the storing unit 511.

Figure 29:
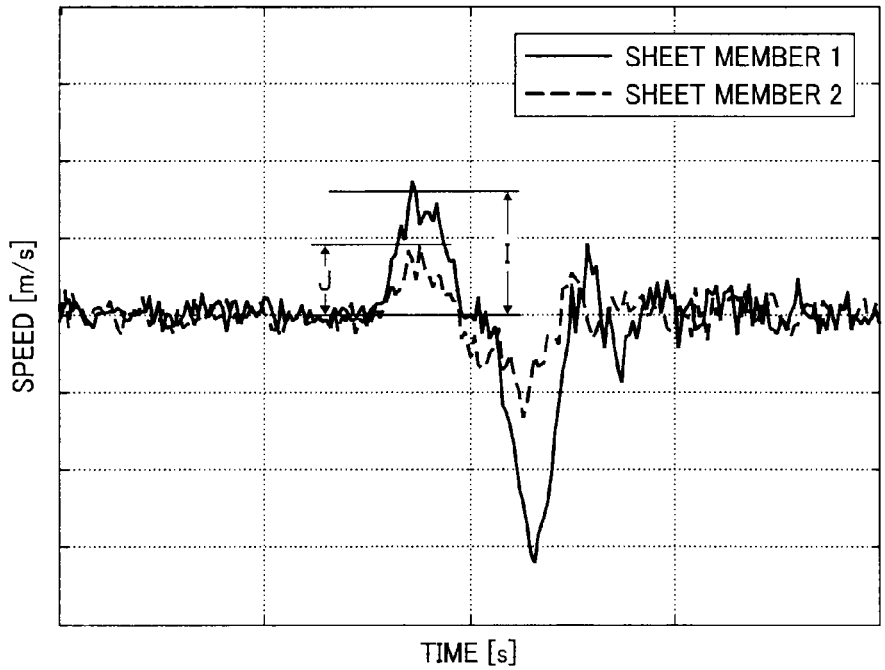
FIG. 29 is a graph of speed fluctuation of the endless belt according to the thickness of the sheet.

The sheet conveying device according to the eighth embodiment formed in this manner focuses that, at the same conveying speed, the amplitude of the velocity curve of the endless belt 16 generated when the sheet W enters the pre-nip B, as show in FIG. 29, changes based on the thickness of the sheet W, and indirectly detects the thickness of the sheet W. In FIG. 29, an amplitude I shows when the sheet W1 is thick, and an amplitude J shows when the sheet W2 is thin. From these, the thickness of the sheet can be identified by comparing the amplitude and the area thereof.

FIG. 29 is a graph of data after applying the method of acquiring the difference shown in the sixth embodiment.

The rotation control of the first driving unit 2 suitable for the thickness is executed, by calling the feedforward reference value suitable for the detected thickness. Then, the correction is made for the reduction of the rotation speed of the endless belt 16 generated when the sheet W enters the nip A.

In the sheet conveying device according to the eighth embodiment, the rotation control of the first driving unit 2 suitable for the thickness is executed, by detecting the thickness of the sheet W. Compared with the linking operation with the paper selecting operation at the image forming apparatus main body side, the generation of a human error (such as making a mistake in setting a paper sheet) can be eliminated. Because the rotary encoder 4 and the like of the sheet conveying device of the present embodiment are used, there is no need to set a separate thickness detecting unit. As a result, increase in cost can be suppressed.

A displacement sensor (thickness detecting unit) that detects the thickness of the sheet W can be provided separately. The displacement sensor that detects the thickness of the sheet W, for example, may use an optical sensor and arranges the optical sensor opposite to the sheet W. The thickness of the sheet W can be detected by the distance from the sensor to the sheet W measured by the respective optical sensors. The other known thickness measuring techniques can also be used.

Figure 30:
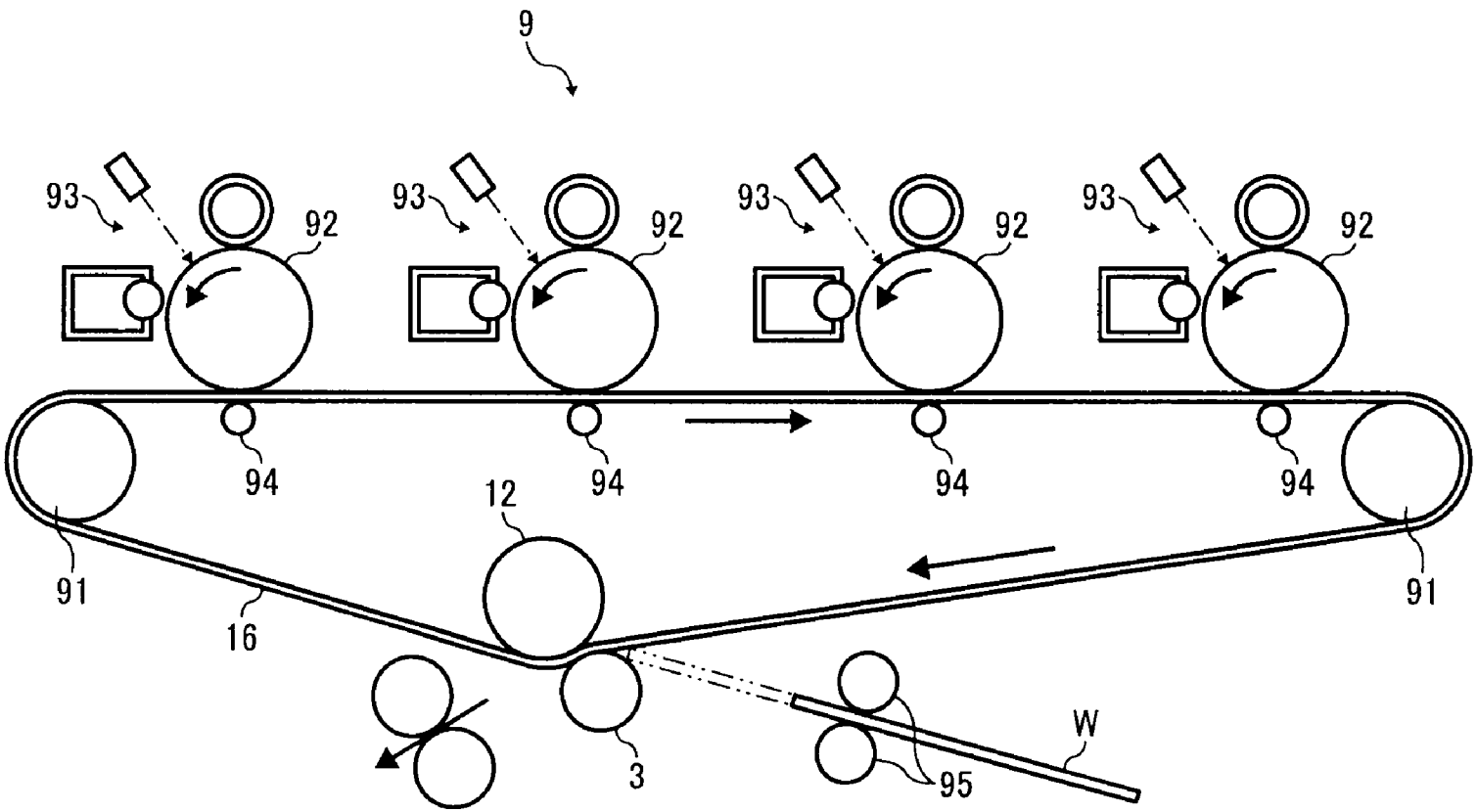
FIG. 30 is a schematic view of an image forming apparatus applied with the sheet conveying device according to each embodiment.

A sheet conveying device according to the present invention is applicable and suitable for a transferring unit that uses an intermediate transfer belt and a fixing unit that uses a fixing belt in the electrophotographic image forming apparatus. In a ninth embodiment, an image forming apparatus 9 using an electrophotographic method that can form a full color image applicable to a secondary transferring unit of the intermediate transfer belt will be explained. The image forming apparatus 9 according to the ninth embodiment, as shown in FIG. 30, includes a pair of support rollers 91 that are horizontally and rotatably supported at a predetermined interval, the driving roller 12 rotatably supported in the center between and arranged slightly lower than the support rollers 91, and an intermediate transfer belt 16 (endless belt) set over the rollers and rotates anticlockwise by the rotation of the driving roller 12. The image forming apparatus 9 also includes a photosensitive body 92 rotatably set at a predetermined interval at four positions on the upper side of the belt along the intermediate transfer belt 16, an image forming unit 93 that forms a toner image by forming a latent image on the photosensitive body 92 and developing the latent image, and a primary transferring roller 94 arranged opposite to the photosensitive body 92 interposing the intermediate transfer belt 16 and electrostatically transfers the toner image on the photosensitive body 92 on the surface of the intermediate transfer belt 16. A secondary transferring roller 3 (second roller) rotatably supported so as to face the driving roller 12 interposing the intermediate transfer belt 16 therebetween, and electrostatically transfers the toner image on the intermediate transfer belt 16 on a recording paper W (sheet) is also included.

In the above-described configuration, the secondary transferring unit includes the driving roller 12, the intermediate transfer belt 16 (endless belt), and the secondary transferring roller 3 (second roller). The secondary transferring unit is arranged at the upstream side in the belt conveying direction than the driving roller 12, and a pre-nip and a nip that are the same as those in the first to the sixth embodiments are formed continuously.

The image forming apparatus 9 according to the ninth embodiment formed in this manner carries out a known image forming method. The image forming unit 93 that corresponds to each photosensitive body 92 forms a latent image and a toner image in each color on each photosensitive body 92. Each primary transferring roller 94 electrostatiscally transfers the toner image in each color on each photosensitive body 92 so as to superimpose on the surface of the intermediate transfer belt 16. Then, the secondary transferring roller 3 secondarily transfers the toner image superimposed on the surface of the intermediate transfer belt 16, on a recording paper W moved at a predetermined timing by a pair of resist rollers 95. During the secondary transfer, the feedforward control explained in the first to the eighth embodiments will be carried out.

The image forming apparatus 9 of this type sometimes includes a thick paper mode substantially the same function as the paper selecting operation explained in the first embodiment. The thick paper mode optimizes the image forming process with the thick recording paper W. However, the correction (feedforward control) by the correction control unit may only be made when the thick paper mode is selected by a user. The thick paper mode may further be segmented (for example, medium thick paper, thick paper (large), and thick paper (small)) based on the type of the recording paper W.

Whether the thickness of the recording paper W is equal to or more than a predetermined thickness is determined, by using the thickness detection (including thickness detection by the displacement sensor) of the sheet W explained in the eighth embodiment. When the determination result is equal to or more than the predetermined thickness, the feedforward control may be carried out by automatically moving to the thick paper mode. Or, by automatically moving to the optimum thick paper mode (for example, medium thick paper, thick paper (large), and thick paper (small)) based on the detected thickness, the correction control unit may carry out the optimum correction (feedforward control) depending on the thickness.

The sheet conveying device and the image forming apparatus 9 according to the present embodiment are explained. The above-described embodiments show an example of the exemplary embodiments of the present invention. However, the present invention is not limited to the above-described embodiments, and various modifications can be made within the scope of the present invention.

As described above, according to an aspect of the present invention, by bringing the sheet into contact with a predetermined position of the endless belt at the upstream side in the conveying direction from an entrance of the nip portion, and by detecting a fluctuation of the endless belt generated at that time by the fluctuation detecting unit, the entry timing estimating unit estimates the entry timing of the sheet into the nip portion. Accordingly, no error caused by using an operation timing of other mechanisms or no error in the sensor detection position will occur, thereby enabling to provide a sheet conveying device that can estimate the accurate timing for the feedforward control. Moreover, the fluctuation of the conveying speed generated when the sheet enters the nip portion can be controlled in high accuracy.

By applying such a sheet conveying device to an image forming apparatus, the image quality can further be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device that includes a first roller over which an endless belt is supported, a second roller arranged opposite to the first roller, and a first driving unit that drives the endless belt, and conveys a sheet to a nip portion formed by pressing the first roller and the second roller against each other with the endless belt therebetween, the sheet conveying device comprising:

a fluctuation information acquiring unit that acquires fluctuation information of the endless belt;

a fluctuation detecting unit that detects a fluctuation of the endless belt generated when the sheet is brought into contact with a predetermined position of the endless belt at an upstream side in a conveying direction from the nip portion, based on the fluctuation information acquired by the fluctuation information acquiring unit;

an entry timing estimating unit that estimates entry timing of the sheet into the nip portion based on a detection of the fluctuation by the fluctuation detecting unit;

a correction control unit that corrects a speed fluctuation of the endless belt generated when the sheet enters the nip portion by performing a feedforward control of the first driving unit based on the entry timing estimated by the entry timing estimating unit; and a third roller over which the endless belt is set, and that is movably supported to a main body of the device and biased by a biasing unit in a direction that gives a tension to the endless belt, wherein the fluctuation information acquiring unit includes an upstream side fluctuation information acquiring unit that acquires the fluctuation information of the endless belt from the predetermined position to the third roller in an upstream direction of the conveying direction, and a downstream side fluctuation information acquiring unit that acquires the fluctuation information of the endless belt from the predetermined position to the third roller in a downstream direction of the conveying direction, and the fluctuation detecting unit produces difference data of the fluctuation information acquired by the upstream side fluctuation information acquiring unit and the downstream side fluctuation information acquiring unit, and detects the fluctuation of the endless belt generated when the sheet is brought into contact with the endless belt from the difference data.

2. The sheet conveying device according to claim 1, further comprising:

a sheet detecting unit that detects a position of the sheet in a conveying path of the sheet, wherein the fluctuation detecting unit stores therein a required conveying time from when the sheet detecting unit detects the sheet to when the sheet is brought into contact with the endless belt in advance, and detects the fluctuation of the endless belt generated when the sheet is brought into contact with the endless belt, for a predetermined period including a time point when the sheet starts contacting with the endless belt.

3. The sheet conveying device according to claim 1, wherein the entry timing estimating unit stores therein a required conveying time of the sheet from the predetermined position to an entrance of the nip portion in advance, and estimates the entry timing of the sheet into the nip portion having a counting of the required conveying time triggered by a detection of the fluctuation by the fluctuation detecting unit.

4. The sheet conveying device according to claim 3, wherein the nip portion includes a pre-nip formed when the endless belt is brought into contact with the second roller, and a nip formed when the endless belt, the first roller, and the second roller are brought into contact, the predetermined position is positioned at an upstream side of a sheet conveying direction from the pre-nip, the required conveying time is a time required to convey the sheet from the predetermined position to an entrance of the pre-nip, and the entry timing estimating unit estimates the entry timing of the sheet into the pre-nip.

5. The sheet conveying device according to claim 3, wherein the nip portion includes a pre-nip formed when the endless belt is brought into contact with the second roller, and a nip formed when the endless belt, the first roller, and the second roller are brought into contact, the predetermined position is where the pre-nip is, the required conveying time is a time required to convey the sheet from the predetermined position to an entrance of the nip, and the entry timing estimating unit estimates the entry timing of the sheet into the nip.

6. The sheet conveying device according to claim 3, wherein the nip portion includes a nip formed when the endless belt, the first roller, and the second roller are brought into contact, the predetermined position is positioned at an upstream side in a sheet conveying direction from the nip, the required conveying time is a time required to convey the sheet from the predetermined position to an entrance of the nip, and the entry timing estimating unit estimates the entry timing of the sheet into the nip.

7. The sheet conveying device according to claim 4, wherein the correction control unit corrects the speed fluctuation of the endless belt generated at an entry into the pre-nip and the nip.

8. The sheet conveying device according to claim 5, wherein the correction control unit corrects the speed fluctuation of the endless belt generated at an entry into the nip.

9. The sheet conveying device according to claim 6, wherein the correction control unit corrects the speed fluctuation of the endless belt generated at an entry into the nip.

10. The sheet conveying device according to claim 1, wherein the feedforward control by the correction control unit is carried out by using a feedforward reference value set corresponding to the sheet.

11. The sheet conveying device according to claim 10, further comprising:

a feedforward reference value producing unit that produces the feedforward reference value based on the speed fluctuation at the nip portion while the sheet is being conveyed acquired by the fluctuation information acquiring unit, wherein the correction control unit corrects the speed fluctuation of the endless belt using the feedforward reference value produced by the feedforward reference value producing unit.

12. The sheet conveying device according to claim 10, further comprising:

a thickness detecting unit that detects a thickness of the sheet, wherein the feedforward control by the correction control unit is carried out by using the feedforward reference value that corresponds to the sheet matched with the thickness detected by the thickness detecting unit.

13. The sheet conveying device according to claim 10, wherein the device detects the thickness of the sheet based on the fluctuation of the endless belt detected by the fluctuation detecting unit, and the feedforward control by the correction control unit is carried out by using the feedforward reference value that corresponds to the sheet matched with the detected thickness.

14. The sheet conveying device according to claim 10, wherein the device provides a thick paper mode to optimize an image forming process with the sheet that has a large thickness, and the correction control unit carries out a correction when the thick paper mode is selected.

15. An image forming apparatus comprising:

a sheet conveying device applied to at least one of an intermediate transfer unit and a fixing unit, wherein the sheet conveying device conveys a sheet to a nip portion formed by pressing a first roller over which an endless belt is supported and a second roller arranged opposite to the first roller against each other with the endless belt therebetween, and the sheet conveying device includes a first driving unit that drives the endless belt, a fluctuation information acquiring unit that acquires fluctuation information of the endless belt, a fluctuation detecting unit that detects a fluctuation of the endless belt generated when the sheet is brought into contact with a predetermined position of the endless belt at an upstream side in a conveying direction from the nip portion, based on the fluctuation information acquired by the fluctuation information acquiring unit, an entry timing estimating unit that estimates entry timing of the sheet into the nip portion based on a detection of the fluctuation by the fluctuation detecting unit, a correction control unit that corrects a speed fluctuation of the endless belt generated when the sheet enters the nip portion by performing a feedforward control of the first driving unit based on the entry timing estimated by the entry timing estimating unit, and a third roller over which the endless belt is set, and that is movably supported to a main body of the device and biased by a biasing unit in a direction that gives a tension to the endless belt, wherein the fluctuation information acquiring unit includes an upstream side fluctuation information acquiring unit that acquires the fluctuation information of the endless belt from the predetermined position to the third roller in an upstream direction of the conveying direction, and a downstream side fluctuation information acquiring unit that acquires the fluctuation information of the endless belt from the predetermined position to the third roller in a downstream direction of the conveying direction, and the fluctuation detecting unit produces difference data of the fluctuation information acquired by the upstream side fluctuation information acquiring unit and the downstream side fluctuation information acquiring unit, and detects the fluctuation of the endless belt generated when the sheet is brought into contact with the endless belt from the difference data.

* * * * *